US010344556B2

(12) United States Patent
Meeks et al.

(10) Patent No.: US 10,344,556 B2
(45) Date of Patent: Jul. 9, 2019

(54) ANNULUS ISOLATION IN DRILLING/MILLING OPERATIONS

(71) Applicant: WEATHERFORD TECHNOLOGY HOLDINGS, LLC, Houston, TX (US)

(72) Inventors: Arthur W. Meeks, Porter, TX (US); Matthew D. Garcia, Houston, TX (US); Albert Odell, II, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 197 days.

(21) Appl. No.: 15/208,472

(22) Filed: Jul. 12, 2016

(65) Prior Publication Data

US 2018/0016862 A1 Jan. 18, 2018

(51) Int. Cl.

| | |
|---|---|
| ***E21B 33/128*** | (2006.01) |
| ***E21B 29/00*** | (2006.01) |
| ***E21B 33/129*** | (2006.01) |
| ***E21B 17/06*** | (2006.01) |
| *E21B 34/06* | (2006.01) |

(52) U.S. Cl.

CPC ..... *E21B 33/128* (2013.01); *E21B 17/06* (2013.01); *E21B 29/00* (2013.01); *E21B 33/129* (2013.01); *E21B 33/1293* (2013.01); *E21B 34/06* (2013.01)

(58) Field of Classification Search

CPC ... E21B 33/128; E21B 33/129; E21B 33/1293

USPC ..... 166/377

See application file for complete search history.

(56) References Cited

U.S. PATENT DOCUMENTS

| | | | |
|---|---|---|---|
| 3,288,221 | A | 11/1966 | Howard et al. |
| 3,416,609 | A | 12/1968 | Kilgore |
| 3,797,572 | A | 3/1974 | Mignotte |
| 4,271,903 | A | 6/1981 | Slagle, Jr. et al. |

(Continued)

FOREIGN PATENT DOCUMENTS

| | | | |
|---|---|---|---|
| EP | 0554013 | A1 | 4/1993 |
| WO | 01/83938 | A1 | 11/2001 |
| WO | 2014012056 | A2 | 1/2014 |

OTHER PUBLICATIONS

International Preliminary Report on Patentability dated Jul. 10, 2013 for PCT Patent Application No. PCT/US12/020533, 7 pages.

(Continued)

*Primary Examiner* — Taras P Bemko

(74) *Attorney, Agent, or Firm* — Smith IP Services, P.C.

(57) ABSTRACT

A method can include increasing a pressure differential from an interior to an exterior of a packer, thereby deactivating a lock that prevents setting of the packer, and applying a compressive load to a tubular string, thereby setting the packer. A packer can include an annular seal that extends radially outward in response to a compressive load applied to opposite ends of the packer, and a lock that prevents relative longitudinal displacement between sections of the packer, the lock including a radially displaceable piston. In another packer, an inner mandrel can have circumferentially spaced apart engagement structures that are engageable with other circumferentially spaced apart engagement structures, displacement of one packer section relative to another packer section in a longitudinal direction being prevented when the engagement structures are engaged, and such displacement being permitted when the engagement structures are rotationally misaligned.

11 Claims, 22 Drawing Sheets

(56) References Cited

U.S. PATENT DOCUMENTS

| | | | |
|---|---|---|---|
| 4,345,649 | A | 8/1982 | Baugh et al. |
| 4,646,829 | A | 3/1987 | Barrington et al. |
| 4,699,216 | A | 10/1987 | Rankin |
| 4,936,387 | A | 6/1990 | Rubbo |
| 5,193,615 | A | 3/1993 | Akkerman |
| 5,826,657 | A | 10/1998 | Ringgenberg |
| 6,322,331 | B1 | 11/2001 | Swatek et al. |
| 6,481,496 | B1 | 11/2002 | Jackson et al. |
| 6,655,461 | B2 | 12/2003 | Eslinger et al. |
| 6,666,275 | B2 | 12/2003 | Neal et al. |
| 6,745,844 | B2 | 6/2004 | Henderson |
| 6,866,095 | B2 | 3/2005 | Skeels |
| 6,896,064 | B2 | 5/2005 | Howlett et al. |
| 7,025,146 | B2 | 4/2006 | King et al. |
| 7,048,055 | B2 | 5/2006 | Hirth |
| 7,051,812 | B2 | 5/2006 | McKee et al. |
| 7,114,574 | B2 | 10/2006 | Bissonnette et al. |
| 7,225,867 | B2 | 6/2007 | MacKenzie et al. |
| 7,314,092 | B2 | 1/2008 | Telfer |
| 7,500,526 | B2 | 3/2009 | Telfer |
| 7,510,016 | B2 | 3/2009 | Telfer |
| 7,543,652 | B2 | 6/2009 | Krawiec et al. |
| 7,748,459 | B2 | 7/2010 | Johnson |
| 7,900,696 | B1 | 3/2011 | Nish et al. |
| 7,909,109 | B2 | 3/2011 | Angman et al. |
| 8,061,430 | B2 | 11/2011 | Du et al. |
| 8,162,066 | B2 | 4/2012 | Farmer et al. |
| 8,555,962 | B2 | 10/2013 | Vestavik |
| 8,851,166 | B2 | 10/2014 | Foubister et al. |
| 2001/0015277 | A1 | 8/2001 | Vaynshteyn et al. |
| 2006/0213656 | A1 | 9/2006 | Clifton |
| 2007/0221372 | A1 | 9/2007 | Telfer |
| 2009/0218092 | A1 | 9/2009 | Booth |
| 2009/0294119 | A1 | 12/2009 | Burnett et al. |
| 2011/0056676 | A1 | 3/2011 | Birner |
| 2014/0238700 | A1 | 8/2014 | Williamson |
| 2015/0013971 | A1 | 1/2015 | Foubister et al. |
| 2015/0101795 | A1 | 4/2015 | Watson et al. |

OTHER PUBLICATIONS

International Search Report dated Apr. 26, 2013 for PCT Patent Application No. PCT/US12/020533, 5 pages.

Written Opinion of the International Search Authority dated Apr. 26, 2013 for PCT Patent Application No. PCT/US12/020533, 6 pages.

Norman J. Hyne, Ph.D., "Nontechnical Guide to Petroleum Geology, Exploration, Drilling, and Production" 2nd edition book, Library of Congress Cataloging-in-Publication Data, dated 2001, Chapter 20, pp. 333-360.

Office Action dated Nov. 7, 2013 for U.S. Appl. No. 13/345,578, 26 pages.

Office Action dated Nov. 13, 2015 for U.S. Appl. No. 14/502,551, 6 pages.

Specification and Drawings filed Jul. 12, 2016 for U.S. Appl. No. 15/208,472, 58 pages.

International Search Report with Written Opinion dated Oct. 30, 2017 for PCT Patent Application No. PCT/US2017/039644, 17 pages.

Office Action dated Apr. 12, 2018 for U.S. Appl. No. 15/161,909, 37 pages.

Specification and drawings for PCT Patent Application No. PCT/US17/39644, filed Jun. 28, 2017, 52 pages.

ANNULUS ISOLATION IN DRILLING/MILLING OPERATIONS

BACKGROUND

This disclosure relates generally to equipment utilized and operations performed in conjunction with a subterranean well and, in an example described below, more particularly provides for annulus isolation in drilling and milling operations.

It can often be useful to isolate sections of a well annulus from each other. In drilling or milling operations, for example, an annular isolator (such as, a packer) can be used to perform well integrity tests.

It will, therefore, be readily appreciated that improvements are continually needed in the arts of designing, constructing and utilizing annular isolators for well drilling and milling operations. Such improvements may be useful in operations other than drilling or milling operations, and may be used for purposes other than performing well integrity tests.

DETAILED DESCRIPTION

Figure 1:
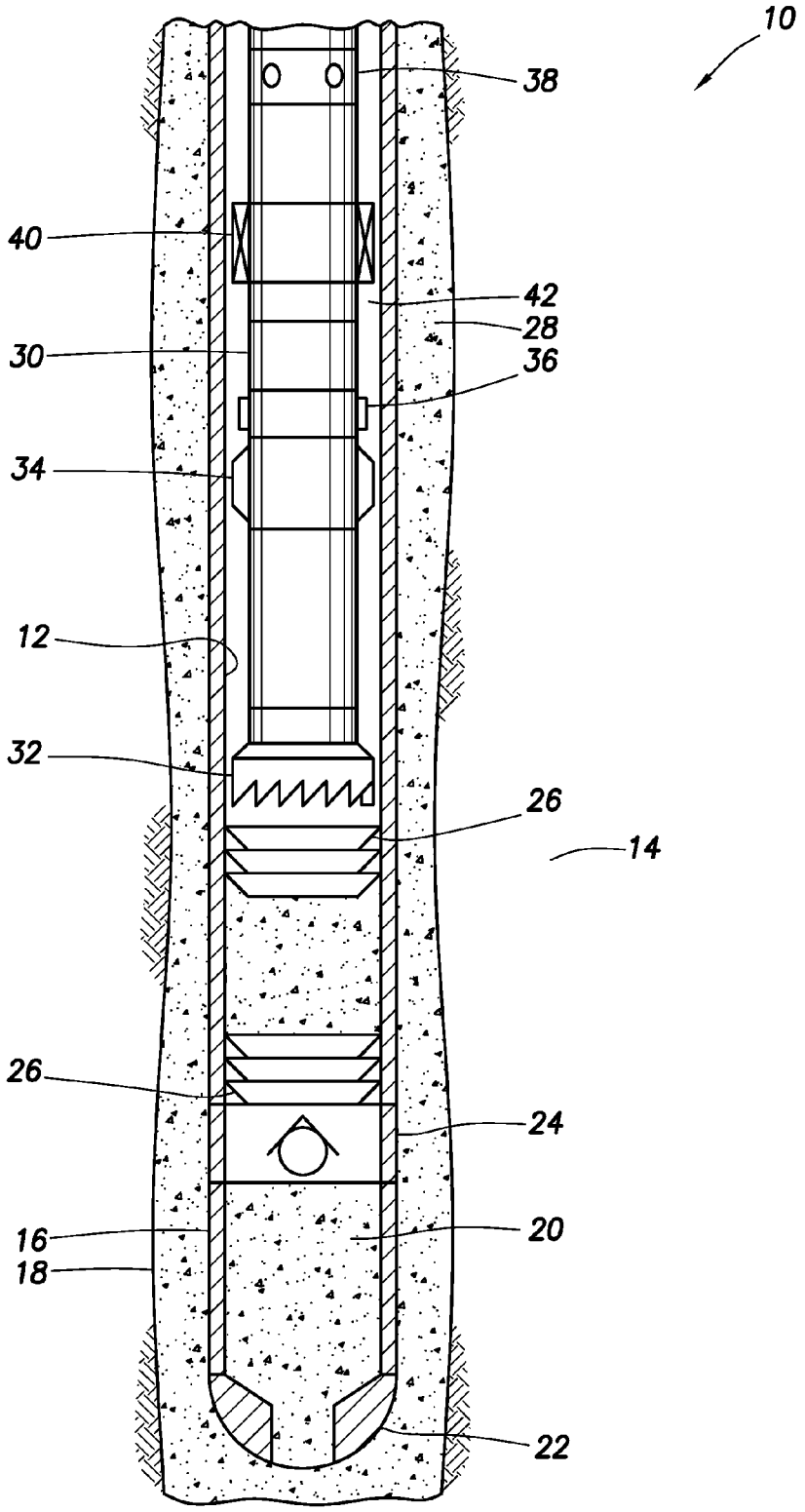
FIG. 1 is a representative partially cross-sectional view of an example of a well system and associated method which can embody principles of this disclosure.

Representatively illustrated in FIG. 1 is a system 10 for use with a well, and an associated method, which system and method can embody the principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into an earth formation 14, and the wellbore 12 has been lined with casing 16 and cement 18. As depicted in FIG. 1, the wellbore 12 is generally vertical, but the principles of this disclosure can be readily applied in situations where a wellbore is generally horizontal or otherwise inclined relative to vertical.

In addition, the scope of this disclosure is not limited to situations in which a wellbore is cased and cemented. In other examples, sections of wellbores in which the principles of this disclosure are applied may be uncased or open hole. A liner or other tubular may be used instead of casing (and with or without cementing) in some examples.

Returning to the FIG. 1 example, note that some of the cement 18 remains in the casing 16 after a cementing operation. This is known to those skilled in the art as a "shoe track" 20, since a substantial portion of the cement 18 in the casing 16 will be positioned between a guide shoe 22 and a float shoe 24 in the casing 16.

It is desired, in the FIG. 1 example, to drill out the shoe track 20, along with the shoes 22, 24, cementing plugs 26 and any other obstructions in the casing 16, so that the wellbore 12 can be extended. In addition, it is desired to test an integrity of the well after all obstructions have been removed, so that an effectiveness of the cementing operation can be evaluated. More specifically, pressure tests are to be conducted, in order to ensure that the cement 18 effectively seals off an annulus 28 formed radially between the casing 16 and the formation 14.

To drill out the shoe track 20, a tubular string 30 is conveyed into the wellbore 12, with a cutting tool 32 (such as, a drill bit or a mill) connected at a distal end of the tubular string 30. Such a tubular string would commonly be referred to by those skilled in the art as a "drill string," whether or not a drill bit is actually used.

The tubular string 30 may be comprised of substantially continuous tubing or jointed pipe. Any materials (such as, steel, plastic, composites, etc.) may be used in the tubular string 30.

The cutting tool 32 may be rotated downhole by rotating the tubular string 30 at surface, for example, using a top drive or a rotary table of a rig (not shown) at the surface. In other examples, a fluid motor (such as, a positive displacement Moineau-type mud motor or a drilling turbine, not shown) may be used to rotate the cutting tool 32, without rotating a substantial portion of the tubular string 30.

In the FIG. 1 example, the tubular string 30 includes a scraper 34, a magnet 36, a circulating valve 38 and a packer 40 connected therein. However, it should be clearly understood that the scope of this disclosure is not limited to use of any particular tools, configuration of tools or combination of tools in a tubular string.

The scraper 34 removes any remaining debris from an interior of the casing 16 as the cutting tool 32 drills through the shoe track 20, shoes 22, 24 and plugs 26. The magnet 36 retains any ferromagnetic material that displaces into close proximity to the magnet 36. Any number of scrapers 34 and magnets 36 may be used, as desired.

The circulating valve 38 provides for selective communication between an interior of the tubular string 30 and an annulus 42 formed radially between the tubular string and the casing 16. Any suitable commercially available circulating valve may be used for the valve 38, and the valve 38 may be actuated using any appropriate technique (such as, by application of one or more pressure levels to the interior of the tubular string 30 or to the annulus 42). In some examples, the valve 38 may be repeatedly cycled between open and closed configurations.

The packer 40 is used to seal off the annulus 42 and thereby isolate different sections of the annulus 42 from each other. Such isolation can be useful, in the FIG. 1 example, for pressure testing after the shoe track 20 has been drilled out.

Figure 2:
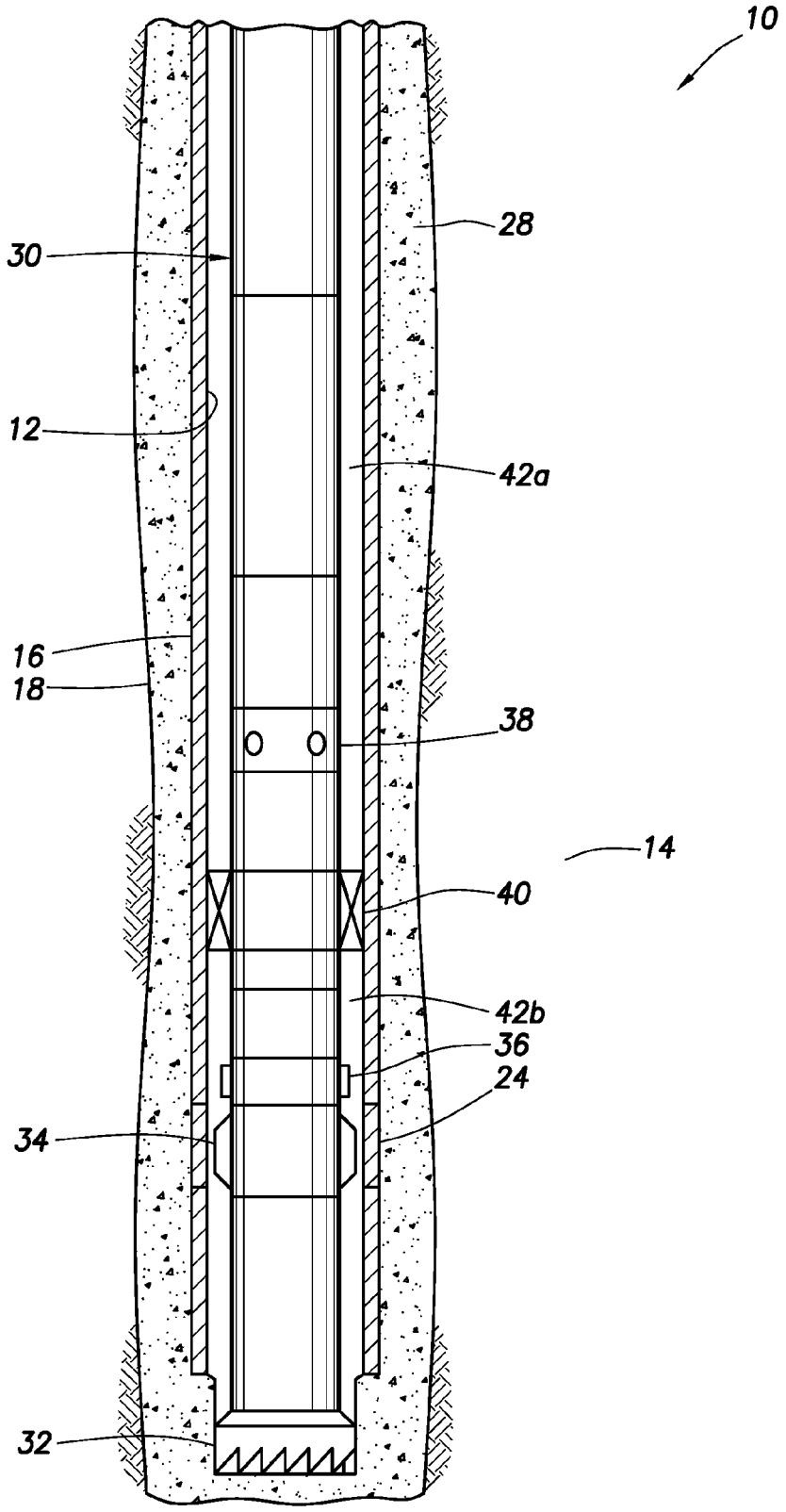
FIG. 2 is a representative partially cross-sectional view of the well system and method, with a packer having been set in a wellbore.

Referring additionally now to FIG. 2, the system 10 and method are representatively illustrated after the shoe track 20 (and other obstructions) have been drilled out. For convenience, the cutting tool 32 is depicted in FIG. 2 as being positioned just beyond the distal end of the casing 16, but in actual practice the cutting tool 32 may be used to drill a substantial distance beyond the casing 16.

As depicted in FIG. 2, the packer 40 is set in the casing 16, thereby isolating sections 42*a,b* of the annulus 42 from each other. Pressure tests may now be performed, for example, by increasing or decreasing pressure in the lower annulus section 42*b* relative to pressure in the formation 14, and monitoring for leakage past the cement 18. The packer 40 sealing effectiveness may be tested by applying a pressure differential between the annulus sections 42*a,b*. However, the scope of this disclosure is not limited to performance of any particular pressure test, or to performance of a pressure test at all.

In this example, the packer 40 is set by applying a pressure differential from an interior to an exterior of the packer 40, and then applying a compressive load to the tubular string 30. The compressive load can be applied, for example, by slacking off on the tubular string 30 at the surface.

Note that the distal end of the tubular string 30 is "bottomed out" or "tagging bottom" as depicted in FIG. 2. In this manner, a weight of the tubular string 30 is applied as the compressive load when tension in the tubular string 30 is reduced at the surface.

Figure 3:
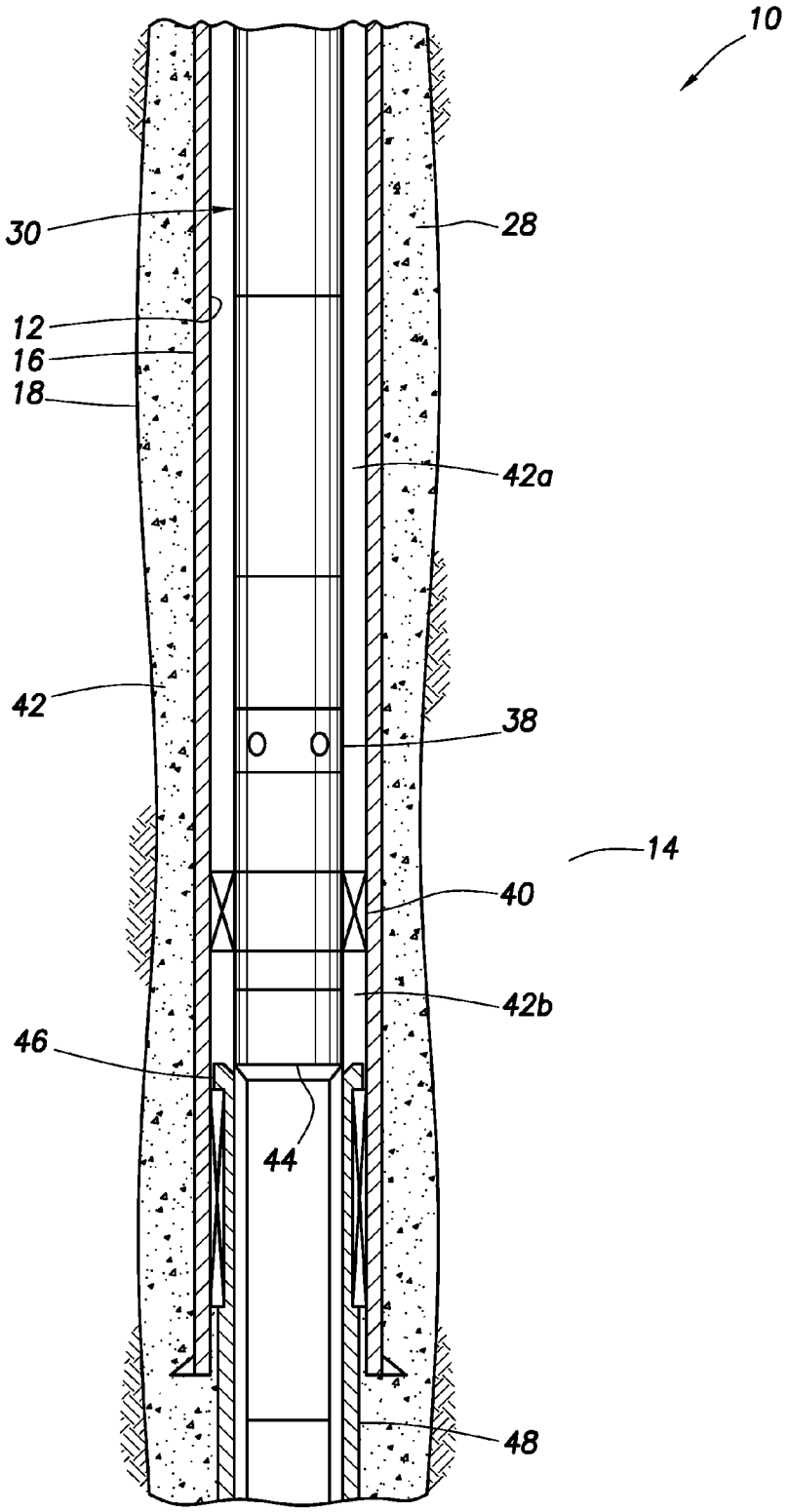
FIG. 3 is a representative partially cross-sectional view of another example of the well system and method, with the packer set in the wellbore.

Referring additionally now to FIG. 3, another example of the system 10 and method is representatively illustrated. In this example, The compressive load used to set the packer 40 is not applied after tagging bottom with the tubular string 30. Instead, the compressive load is applied by slacking off on the tubular string 30 at the surface after engaging a shoulder 44 on the tubular string 30 with a top of a liner hanger 46 used to secure a liner string 48 below the casing 16.

The packer 40 may be used in this example for pressure testing the liner hanger 46, or for another purpose. Thus, it will be appreciated that the scope of this disclosure is not limited to any particular technique for setting the packer 40, any particular sequence of steps in operations utilizing the packer 40, or to any particular function performed or purpose served by the packer 40.

Referring additionally now to FIGS. 4A-E, an example of the packer 40 is representatively illustrated in successive longitudinal cross-sectional views. The packer 40 is in an initial, run-in configuration as depicted in FIGS. 4A-E.

In this configuration, the packer 40 can be connected in the tubular string 30 and used in the system 10 and method examples of FIGS. 1-3. For clarity of explanation, the packer 40 example of FIGS. 4A-E is described more fully below as it would be used in the system 10 and method examples of FIGS. 1-3. However, the packer 40 may be used in other systems and methods, in keeping with the principles of this disclosure.

Figure 4A:
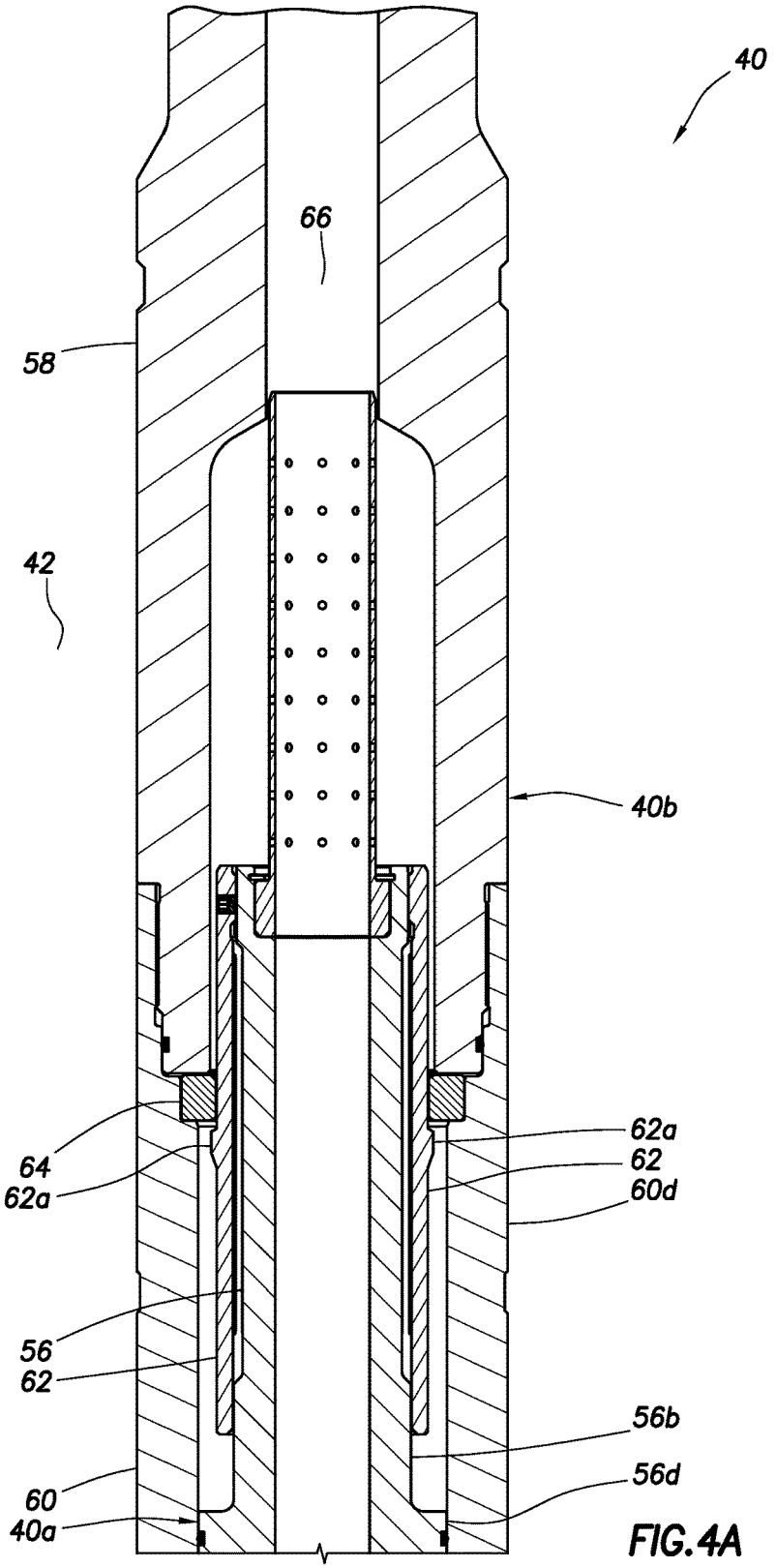
FIGS. 4A-E are representative cross-sectional views of successive longitudinal portions of an example of a packer that may be used with the well systems and methods of FIGS. 1-3, and that may embody the principles of this disclosure.
Figure 4B:
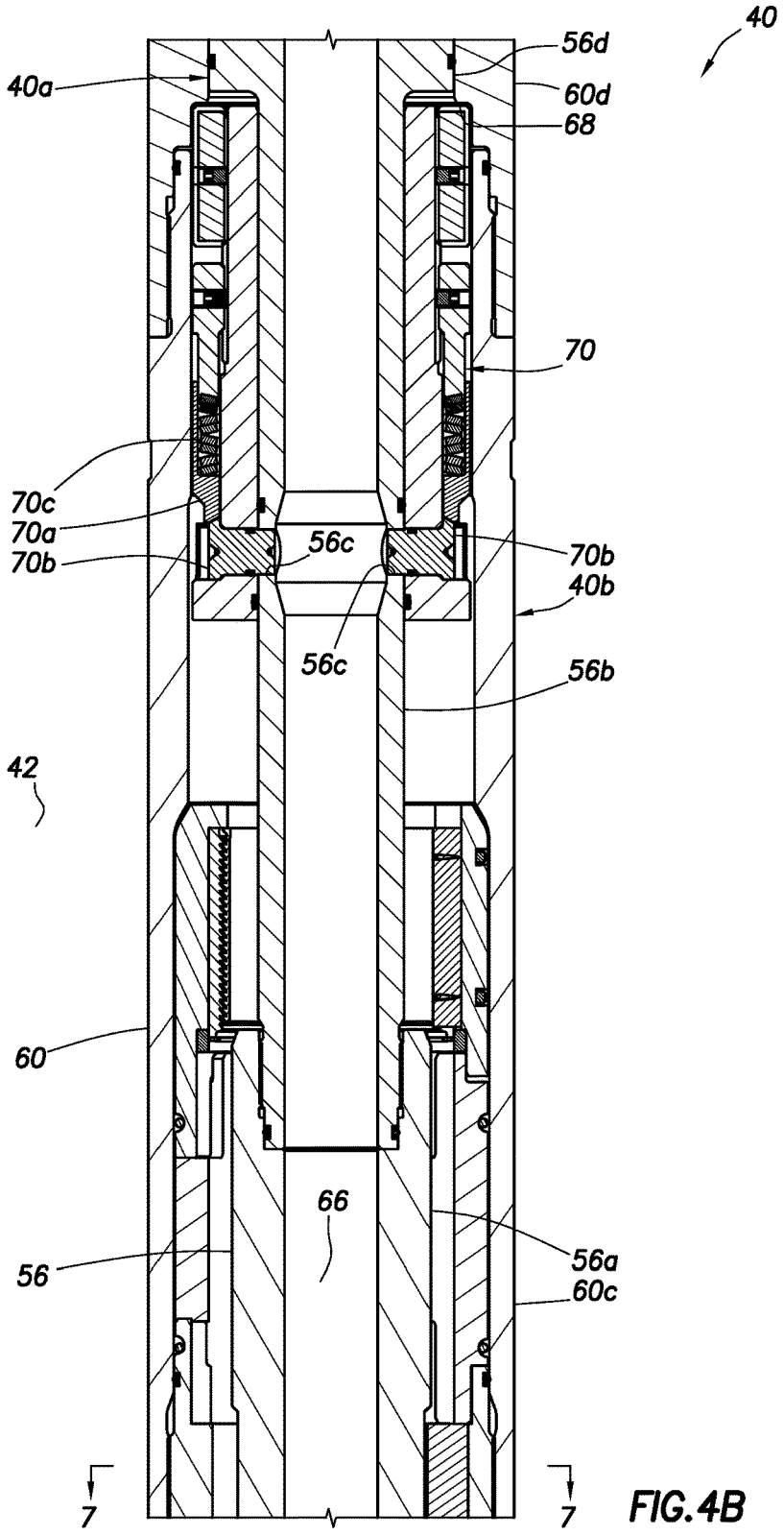
Figure 4C:
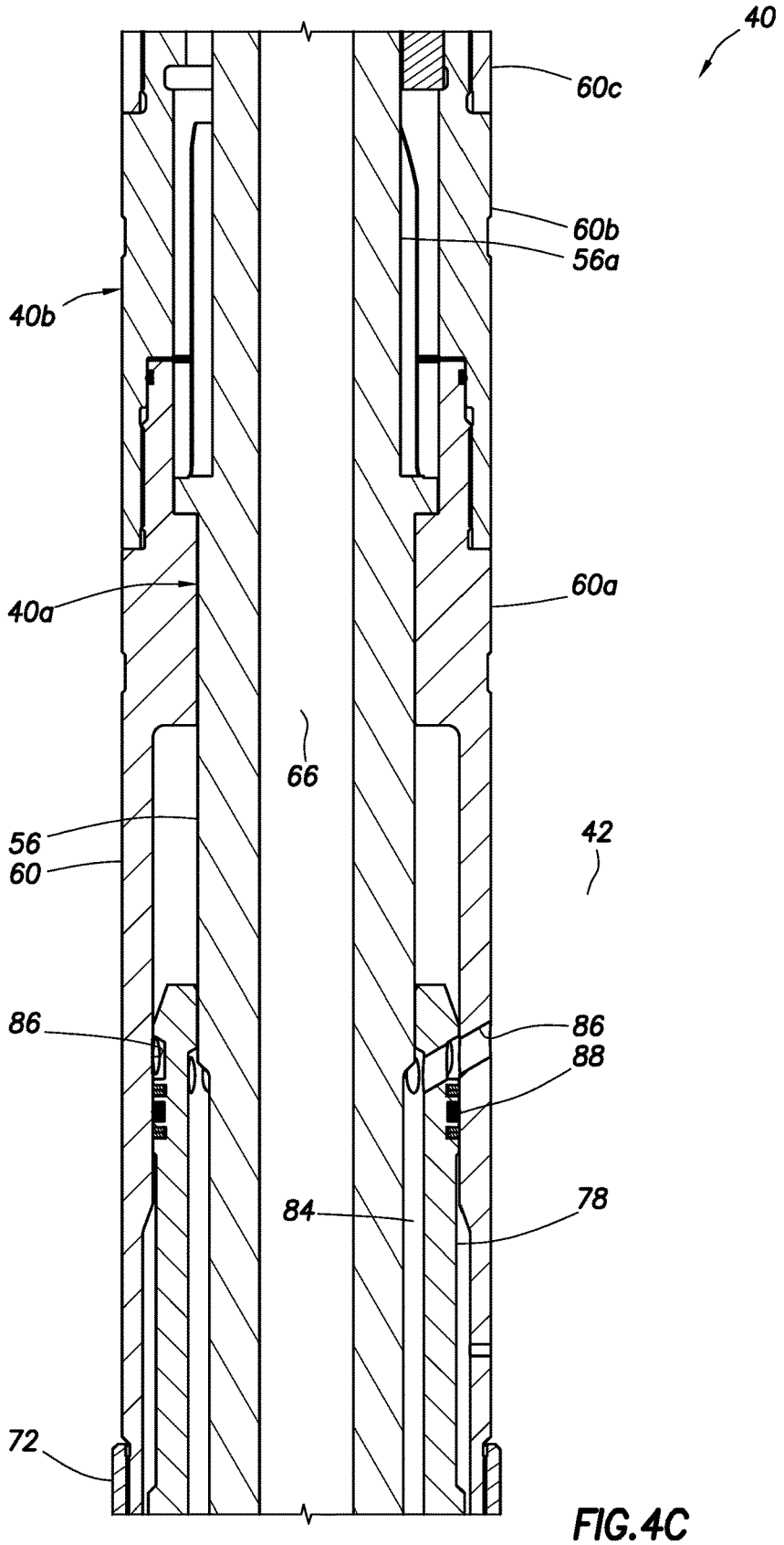
Figure 4D:
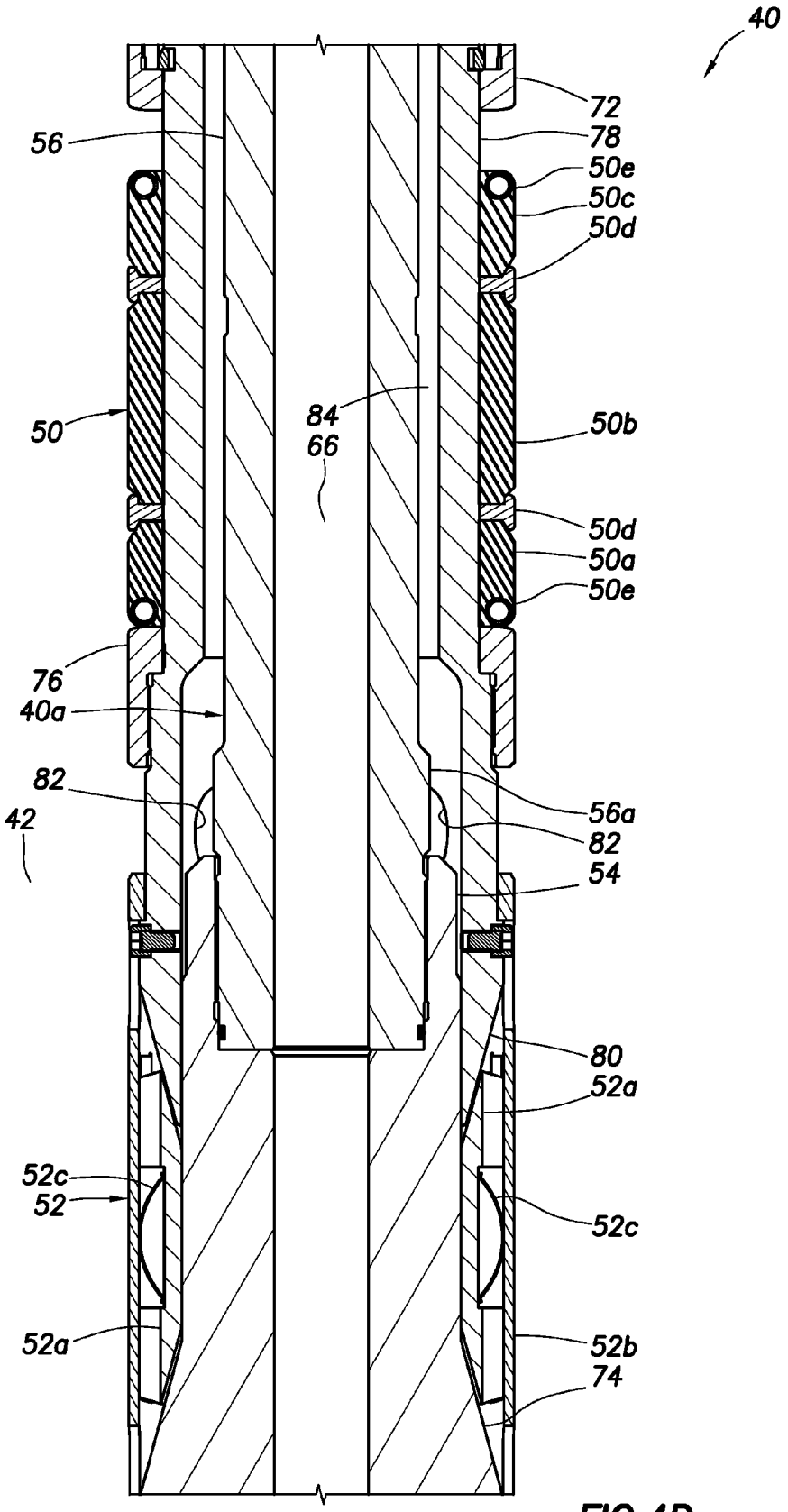
Figure 4E:
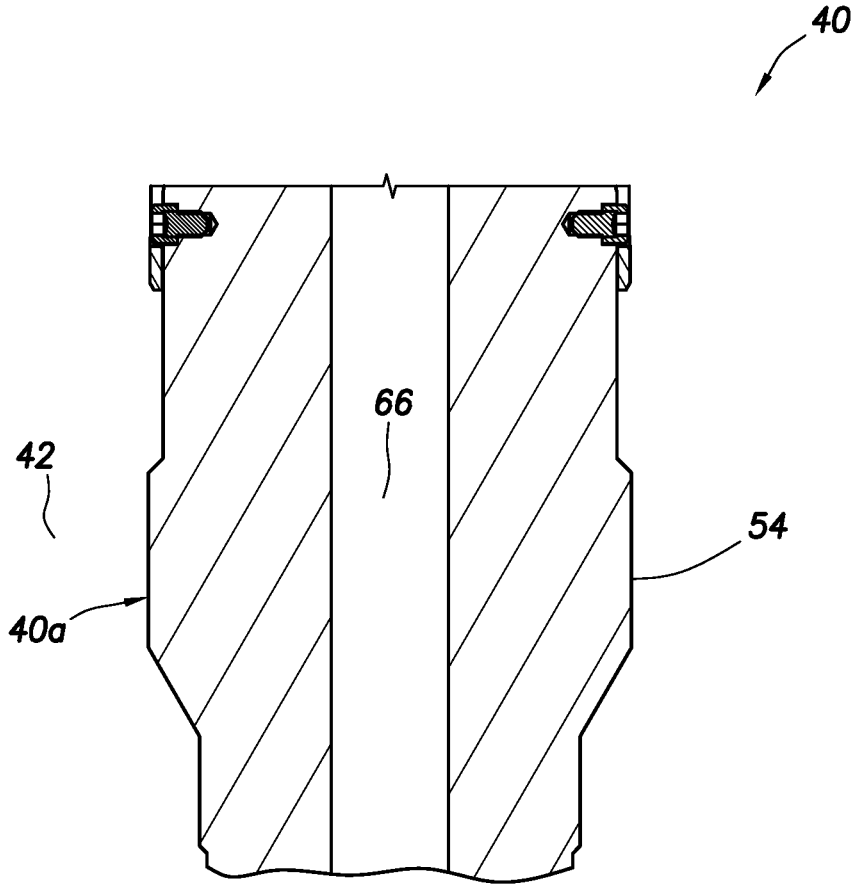

In the FIGS. 4A-E example, the packer 40 includes an annular seal 50 that is radially outwardly extendable in response to a compressive load being applied to the packer 40 when it is set. As depicted in FIG. 4D, the annular seal 50 can include one or more individual seal elements 50*a-c*, dividers 50*d*, and anti-extrusion devices 50*e*.

In other examples, the seal 50 may include different numbers of seal elements, different components, other combinations of components, and different configurations. Thus, the scope of this disclosure is not limited to use of any particular annular seal arrangement or configuration.

The packer 40 also includes a slip or slips 52 that are radially outwardly extendable in response to the compressive load applied to set the packer 40. As depicted in FIGS. 4D & E, the slips 52 can include one or more individual slip members 52*a*, a slip cage or retainer 52*b*, and biasing devices 52*c* to radially inwardly bias the slip members 52*a*.

In other examples, the slips 52 may not be used, or they may be differently configured (e.g., as a single barrel slip or multiple button slips, etc.). The scope of this disclosure is not limited to use of any particular type, number or configuration of slips, or to use of slips on the packer 40 at all (for example, the packer 40 could be set without use of any slips to anchor the packer 40 in the wellbore 12).

When the packer 40 is set, the seal 50 extends radially outward into sealing engagement with an interior of the wellbore 12 (e.g., the interior of the casing 16 in the FIGS. 1-3 examples), and the slips 52 extend radially outward into gripping engagement with the interior of the wellbore 12. In this manner, the annulus 42 is sealed off and the packer 40 is secured against displacement relative to the wellbore 12.

The seal 50 and the slips 52 extend radially outward when there is relative displacement between telescopically arranged sections 40*a,b* of the packer 40. This relative displacement between the sections 40*a,b* occurs after an increased internal pressure is applied, and the compressive load is applied at opposite ends of the packer 40 (the compressive load is transmitted through the packer 40 between its opposite ends).

In the FIGS. 4A-E example, the lower packer section 40*a* includes a lower connector 54 and an inner mandrel 56 comprising multiple sections 56*a,b*. The lower connector 54 may be provided with threads or other suitable structures (not shown) for sealingly connecting the packer 40 in the tubular string 30.

The upper packer section 40*b* includes an upper connector 58 and an outer housing 60 comprising multiple sections 60*a-d*. The upper connector 58 may be provided with threads or other suitable structures (not shown) for sealingly connecting the packer 40 in the tubular string 30.

To initiate setting of the packer 40, a pressure differential from an interior of the packer 40 to an exterior of the packer 40 is increased to a predetermined level, to thereby release or deactivate a lock 70 (see FIG. 4B) that initially prevents relative displacement between the lower and upper packer sections 40*a,b*. For example, an increased pressure may be applied at the surface to an internal flow passage 66 that extends longitudinally through the packer 40 and the remainder of the tubular string 30. In this example, the pressure differential is increased from the flow passage 66 to the annulus 42 external to the packer 40.

A spring-biased latch 70*a* of the lock 70 initially prevents pistons 70*b* from displacing radially outward and out of engagement with openings 56*c* formed radially through the upper inner mandrel section 56*b*. This engagement of the pistons 70*b* with the openings 56*c* prevents the upper packer section 40*b* from displacing downward relative to the lower packer section 40*a*, due to an internal shoulder 68 abutting an upper end of the lock 70.

When the predetermined pressure differential is applied from the interior to the exterior of the packer 40, the latch 70*a* permits the pistons 70*b* to displace radially outward and out of engagement with the openings 56*c*. The predetermined pressure differential can be varied by adjusting a biasing force exerted by biasing devices 70*c* (such as, Bellville washers or compression springs, etc.) of the latch 70.

After the pressure differential has disengaged the lock pistons 70*b*, the pressure differential is reduced in order for a compressive load (described below) to be effective. A piston 56*d* formed on the inner mandrel 56 also prevents the packer 40 from prematurely setting, if the lock pistons 70*b* have been disengaged. The packer 40 can be set, unset (released) and set again, multiple times. But the lock pistons 70*b* cannot be re-set.

When a flow rate through the packer 40 is greater than a certain level, the pressure differential across the piston 56*d* prevents the packer 40 from setting. Any compressive load applied to the packer 40 must overcome a force due to the pressure differential across the piston 56*d* before any movement can occur, and began to engage collets 62 (described more fully below).

Thus, the packer 40 is prevented from setting if the pressure differential across the piston 56*d* is greater than a certain level. The pressure differential across the piston 56*d* is from the interior to the exterior of the packer 40 (an upper side of the piston 56*d* is exposed to pressure in the flow passage 66 and a lower side of the piston 56*d* is exposed to pressure in the annulus 42 in the system 10 example of FIG. 1).

Once the lock pistons 70*b* are disengaged, and the pressure differential is reduced, the compressive load is then applied to the packer 40 by, for example, slacking off on the tubular string 30 at the surface. When the compressive load reaches a predetermined level, the upper packer section 40*b* will displace downward (as viewed in FIGS. 4A-E) relative to the lower packer section 40*a*.

The predetermined compressive load is determined by a set of resilient collets 62 connected at an upper end of the inner mandrel 56 (see FIG. 4A). The collets 62 can deflect radially inward in response to the predetermined compressive load being applied to the lower and upper sections 40*a,b* of the packer 40.

A radially outwardly extending projection 62*a* is formed on each of the collets 62. The projections 62*a* initially have an outer diameter (or lateral dimension) that is greater than an inner diameter of a release ring 64 retained between the upper connector 58 and the upper housing section 60*d*. This prevents the upper packer section 40*b* from displacing downward relative to the lower packer section 40*a* (after the lock pistons 70*b* are disengaged).

When the predetermined compressive load is applied to the packer 40, however, the collets 62 will deflect radially inward until their outer diameter (or lateral dimension) is no greater than the inner diameter of the release ring 64, thereby permitting the release ring and the remainder of the upper packer section 40*b* to displace downward relative to the lower packer section 40*a*.

Note that, prior to the lock 70 being deactivated by increasing the pressure differential as described above, a compressive load equal to or greater than the predetermined compressive load cannot cause the upper packer section 40*b* to displace downward relative to the lower packer section 40*a*, due to the engagement of the pistons 70*b* in the openings 56*c*. Thus, while the tubular string 30 is being run into the wellbore 12 in the FIGS. 1-3 examples, the packer 40 cannot be inadvertently set in response to friction drag or obstructions encountered by the tubular string 30 in the wellbore 12.

Previous packer designs have used shear pins or other types of shearable members to prevent inadvertent setting. However, as such packer designs are run into wellbores, compressive forces due to friction drag and obstructions encountered in the wellbores act on the shearable members, and can gradually cause fatigue and shearing of the members, allowing these packer designs to prematurely set. Because the packer 40 of FIGS. 4A-E does not use shearable members to prevent premature setting, friction drag and obstructions cannot cause the packer 40 to prematurely set while it is being run into the wellbore 12.

The seal 50 and slips 52 (see FIG. 4D) are positioned on the packer 40 longitudinally between components of the lower and upper sections 40*a,b* of the packer 40. Specifically, a gauge ring 72 at a lower end of the upper packer section 40*b* is positioned above the seal 50, and a frusto-conical wedge 74 formed on the lower connector 54 is positioned below the slips 52.

Thus, as the upper packer section 40*b* is displaced downward relative to the lower packer section 40*a*, the seal 50 and slips 52 will be longitudinally compressed between the gauge ring 72 and the wedge 74. More specifically, the gauge ring 72 will contact the seal 50 and cause the seal (along with a lower gauge ring 76 and a support sleeve 78) to displace downward.

Another frusto-conical wedge 80 is formed at a lower end of the support sleeve 78. As the support sleeve 78 displaces downward, the wedges 74, 80 displace the slip members 52*a* radially outward into gripping engagement with the wellbore 12.

When the slip members 52*a* have been fully outwardly extended, downward displacement of the support sleeve 78 will cease. Continued downward displacement of the upper packer section 40*b* will then result in the seal 50 being longitudinally compressed between the gauge rings 72, 76. This longitudinal compression of the seal 50 will cause the seal elements 50*a-c* to extend radially outward into sealing engagement with the wellbore 12. The packer 40 will then be in a set configuration (described more fully below in relation to FIGS. 9A-D).

Note that ports 82 are formed through the support sleeve 78 between the seal 50 and the slips 52. The ports 82 provide fluid communication between the exterior of the packer 40 and an internal annular bypass passage 84 formed radially between the support sleeve 78 and the inner mandrel 56.

In the run-in configuration of FIGS. 4A-E, similar ports 86 (see FIG. 4C) formed through the housing 60 provide for fluid communication between the bypass passage 84 and the exterior of the packer 40 above the seal 50. Thus, as the packer 40 is being run into the wellbore 12, fluid in the wellbore 12 can flow into the ports 82 below the seal 50, through the bypass passage 84, and then out through the ports 86 to the exterior of the packer 40 above the seal 50.

In this manner, a substantial portion of the fluid "bypasses" the annulus 42 at the seal 50, in that all of the fluid does not flow through a restricted annular area formed radially between the wellbore 12, and the seal 50 and gauge rings 72,76. This reduces pressure surges in the wellbore 12 below the packer 40 as the tubular string 30 is being run into the wellbore 12, and reduces the possibility of erosion damage to the seal 50 (due, for example, to relatively high velocity flow across the seal 50).

When the packer 40 is set, however, downward displacement of the housing 60 relative to the support sleeve 78 (e.g., as the seal 50 is being longitudinally compressed) will cause the ports 86 to displace to an opposite side of a seal 88 (see FIG. 4C) carried on the support sleeve 78. This will prevent fluid communication between the bypass passage 84 and the ports 86, thereby preventing flow through the bypass passage 84 between opposite sides of the seal 50 (and providing for isolation of the annulus sections 42*a,b* depicted in the FIGS. 2 & 3 examples).

Figure 5:
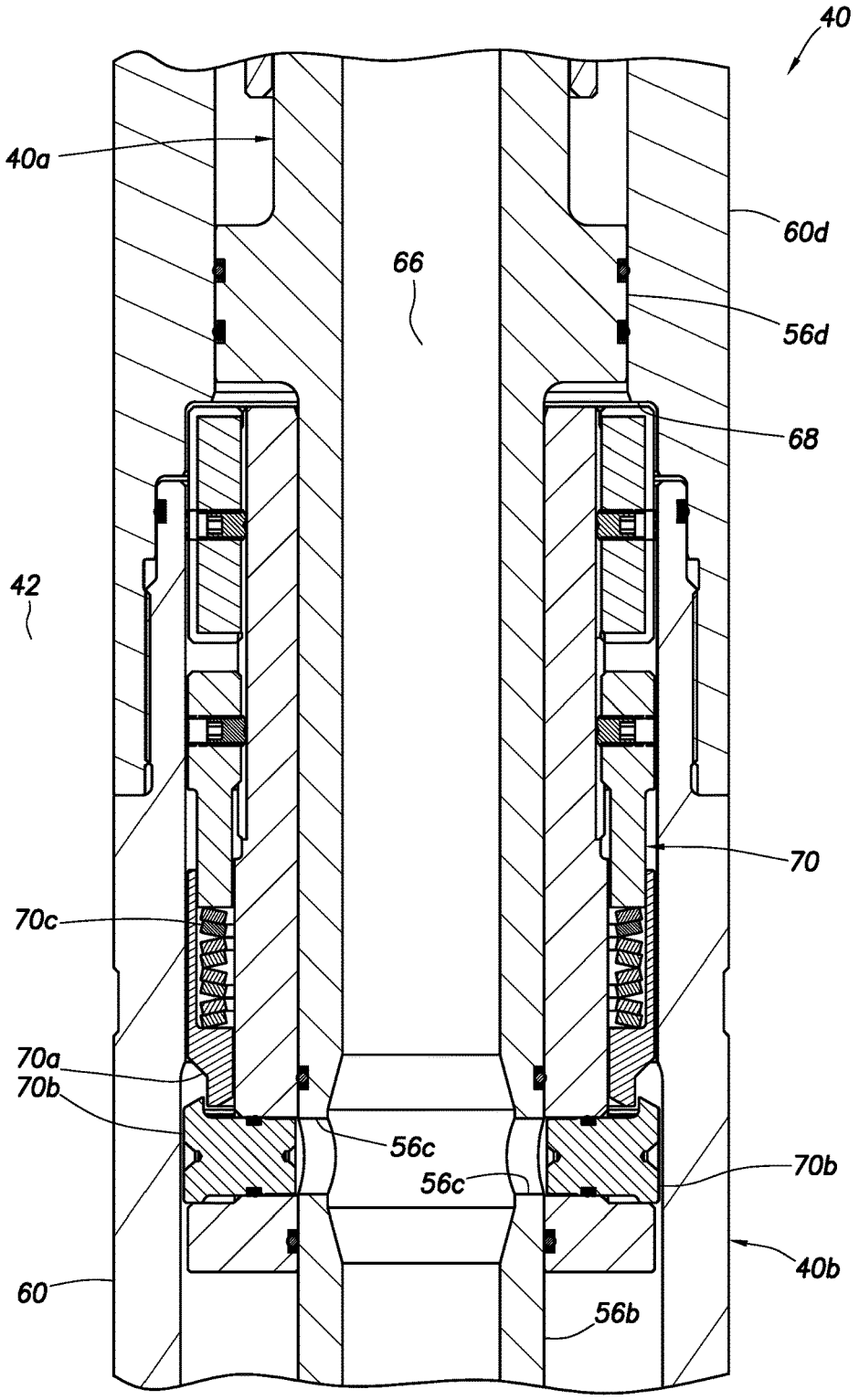
FIG. 5 is a representative cross-sectional view of a lock of the packer, the lock being deactivated.

Referring additionally now to FIG. 5, an enlarged cross-sectional view of the lock 70 in the packer 40 is representatively illustrated. In this view, the lock 70 has been deactivated by increasing the pressure differential from the interior to the exterior of the packer 40, thereby causing the pistons 70*b* to displace radially outward and out of engagement with the openings 56*c* in the inner mandrel 56.

Note that the latch 70*a* now prevents the pistons 70*b* from displacing radially inward and again engaging the openings 56*c*. Thus, once the lock 70 has been deactivated, it cannot later be activated to prevent subsequent setting of the packer 40.

Figure 6:
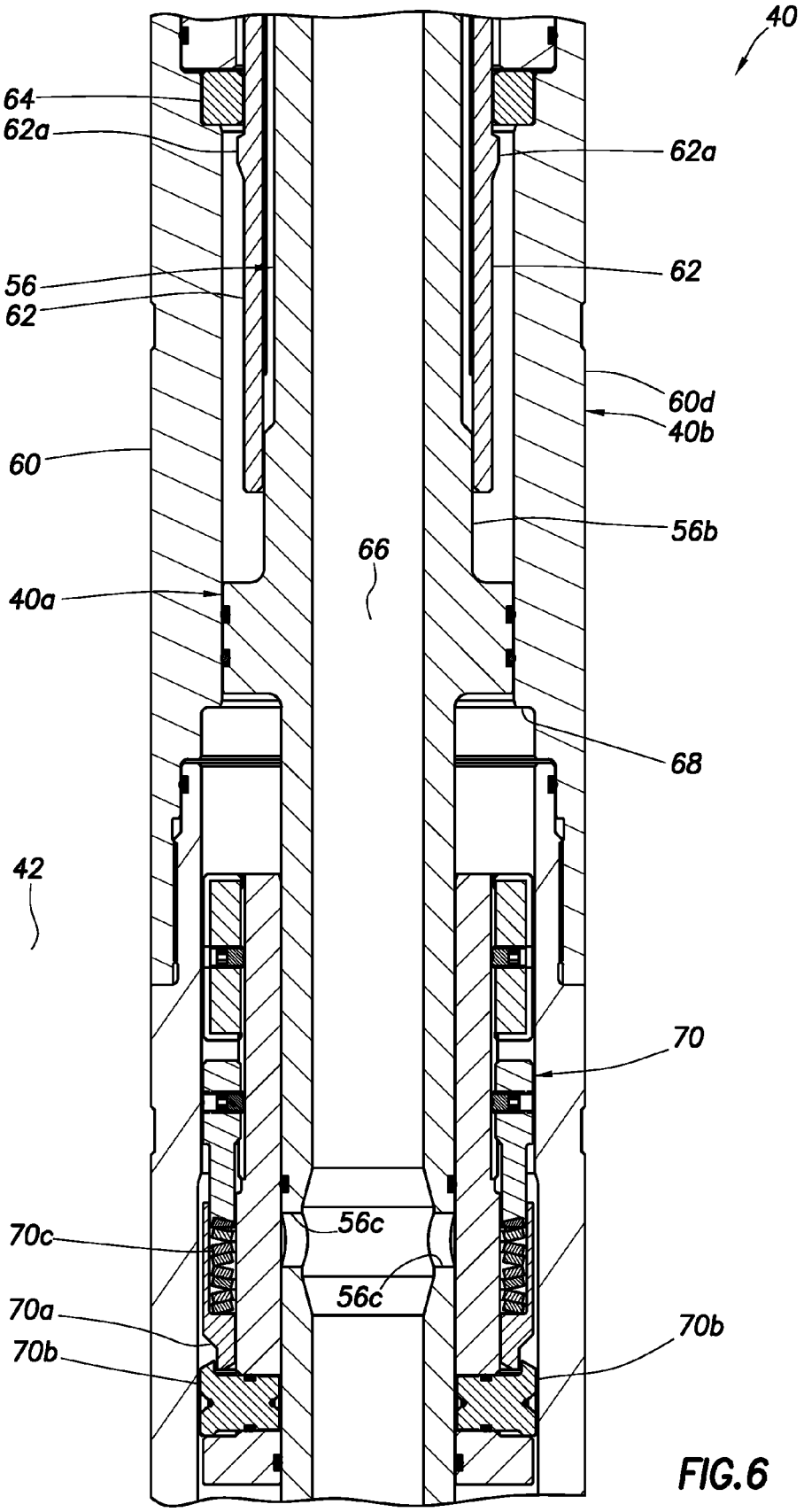
FIG. 6 is another representative cross-sectional view of the lock, the lock being longitudinally displaced.

Referring additionally now to FIG. 6, another cross-sectional view of the lock 70 is representatively illustrated. In this view, the upper packer section 40*b* has been displaced downward relative to the lower packer section 40*a* (in order to set the packer 40), and then the upper packer section 40*b* has been displaced upward relative to the lower packer section 40*a* (in order to unset the packer 40).

Note that the latch 70 displaces downward with the upper packer section 40*b* as it displaces downward relative to the lower packer section 40*a*, but does not then displace upward with the upper packer section 40*b* relative to the lower packer section 40*a* when the packer 40 is unset. For this additional reason, the lock 70 cannot prevent the packer 40 from again being set.

Figure 7:
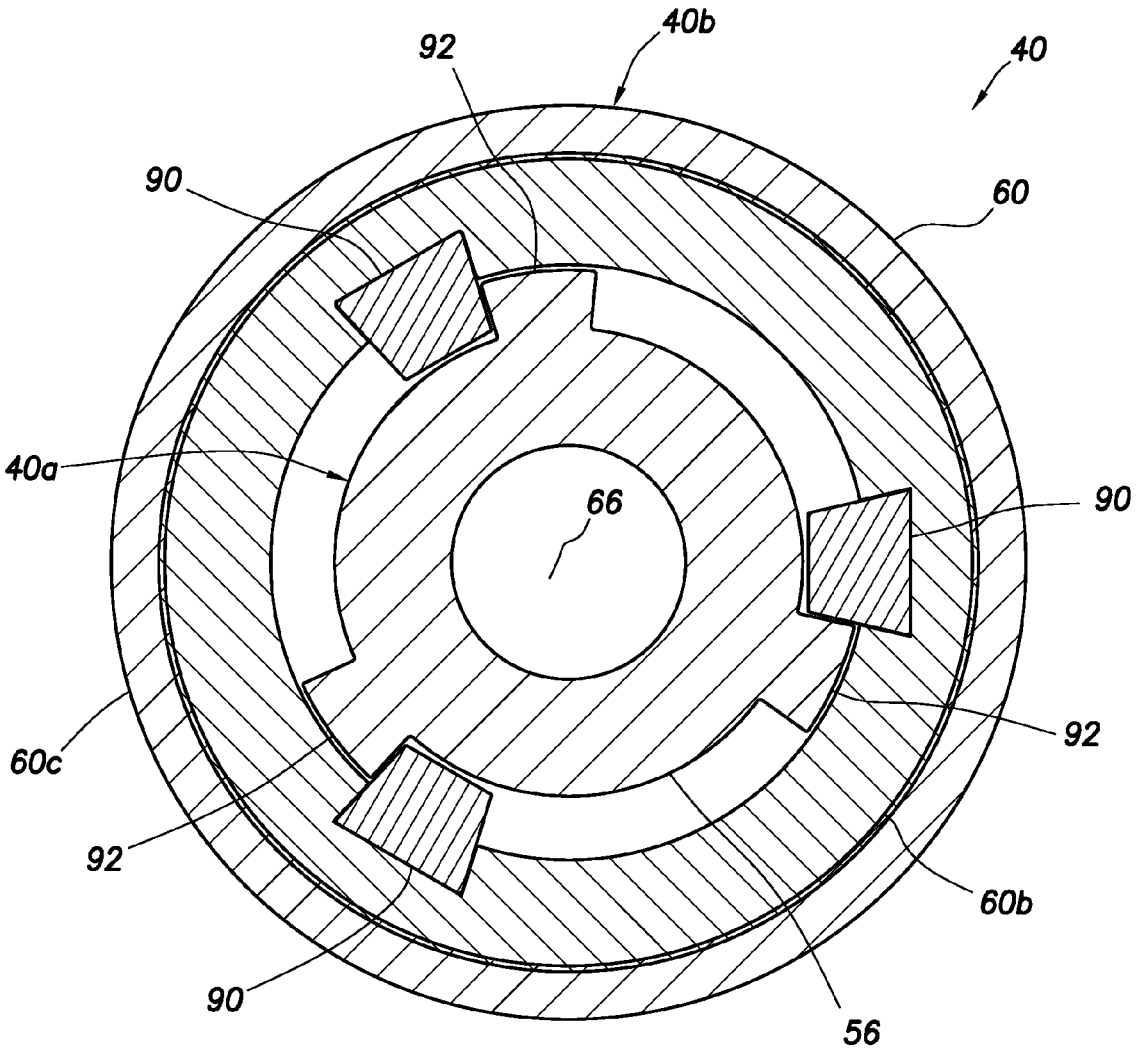
FIG. 7 is a representative lateral cross-sectional view of a torque transfer arrangement of the packer, taken along line 7-7 of FIG. 4B.

Referring additionally now to FIG. 7, a lateral cross-sectional view of the packer 40, taken along line 7-7 of FIG. 4B, is representatively illustrated. In this view, an arrangement providing for torque transfer through the packer 40 can be more clearly seen.

Torque transfer is useful in the FIGS. 1 & 2 example for rotating the cutting tool 32 connected at the distal end of the tubular string 30. In this example, the tubular string 30 can be rotated above the packer 40 (e.g., using a top drive or rotary table at the surface), and the rotation will be transmitted through the packer 40 to the tubular string 30 below the packer 40.

Torque transfer through the packer 40 can be useful for other purposes, such as, actuating tools below the packer 40, achieving a desired rotational position of a tool below the packer 40, unsticking the tubular string 30 below the packer 40, etc. Thus, the scope of this disclosure is not limited to any particular purpose for transferring torque through the packer 40, or to such torque transfer at all.

In the FIG. 7 example, a set of lugs or keys 90 are retained in the housing section 60*b*. When the upper packer section 40*b* is rotated, the keys 90 engage splines 92 formed on the mandrel 56. This engagement causes the lower packer section 40*a* to rotate with the upper packer section 40*b*.

Note that the keys 90 and splines 92 are circumferentially spaced apart from each other, so that some relative rotation between the lower and upper packer sections 40*a,b* is permitted. Such limited relative rotation can be useful in operation of the packer 40, as described more fully below. However, the scope of this disclosure is not limited to any particular amount of relative rotation being permitted between the upper and lower packer sections 40*a,b*, or to any relative rotation at all.

During the cutting operation described above in relation to FIGS. 1 & 2, the tubular string 30 can be rotated to the right (clockwise as viewed from above), in order to rotate the cutting tool 32. In this example, the keys 90 will engage the splines 92 as depicted in FIG. 7. Thus, clockwise rotation of the upper packer section 40*b* causes the keys 90 to engage the splines 92 as depicted in FIG. 7, and this engagement causes the lower packer section 40*a* to rotate with the upper packer section 40*b* (torque being transferred from the upper to the lower packer section 40*b,a*).

Figure 8A:
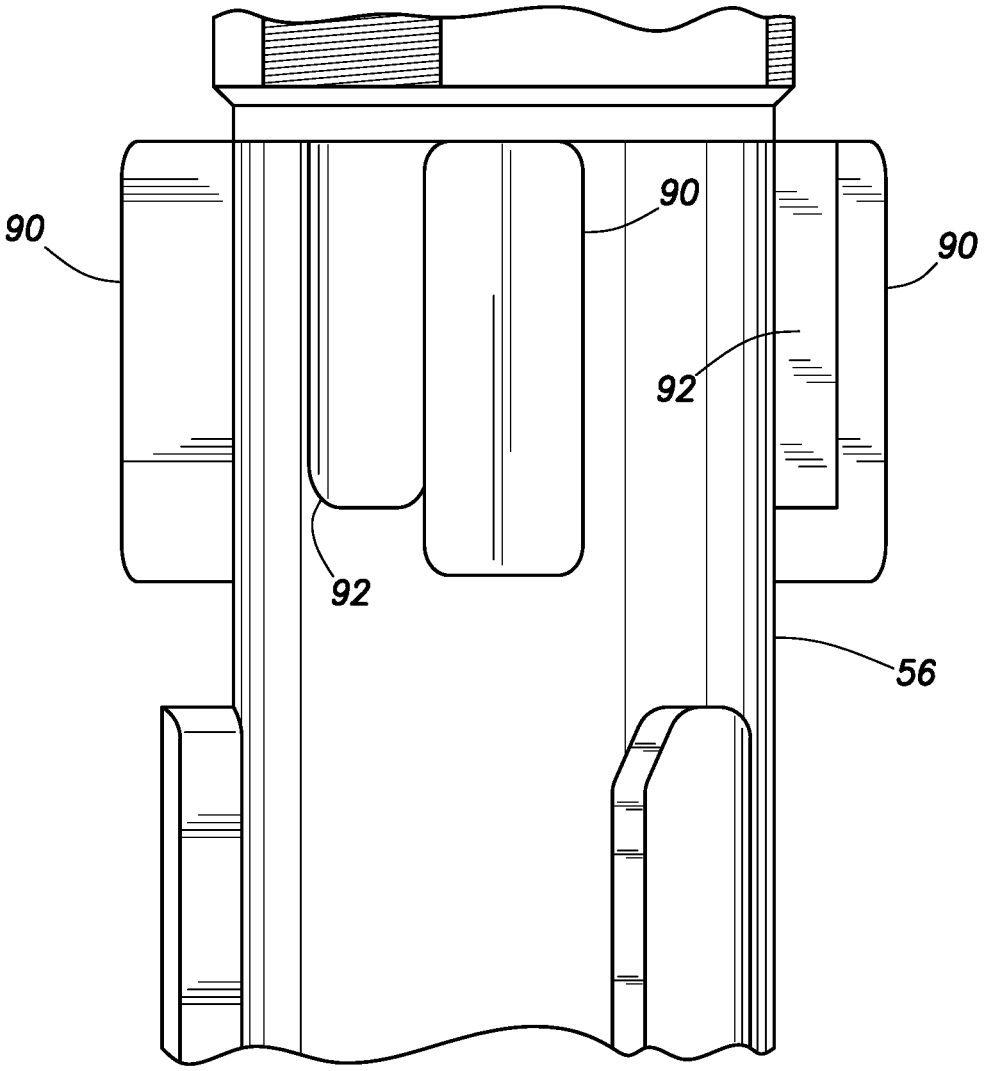
FIGS. 8A-C are representative side views of the torque transfer arrangement in various operational configurations.
Figure 8B:
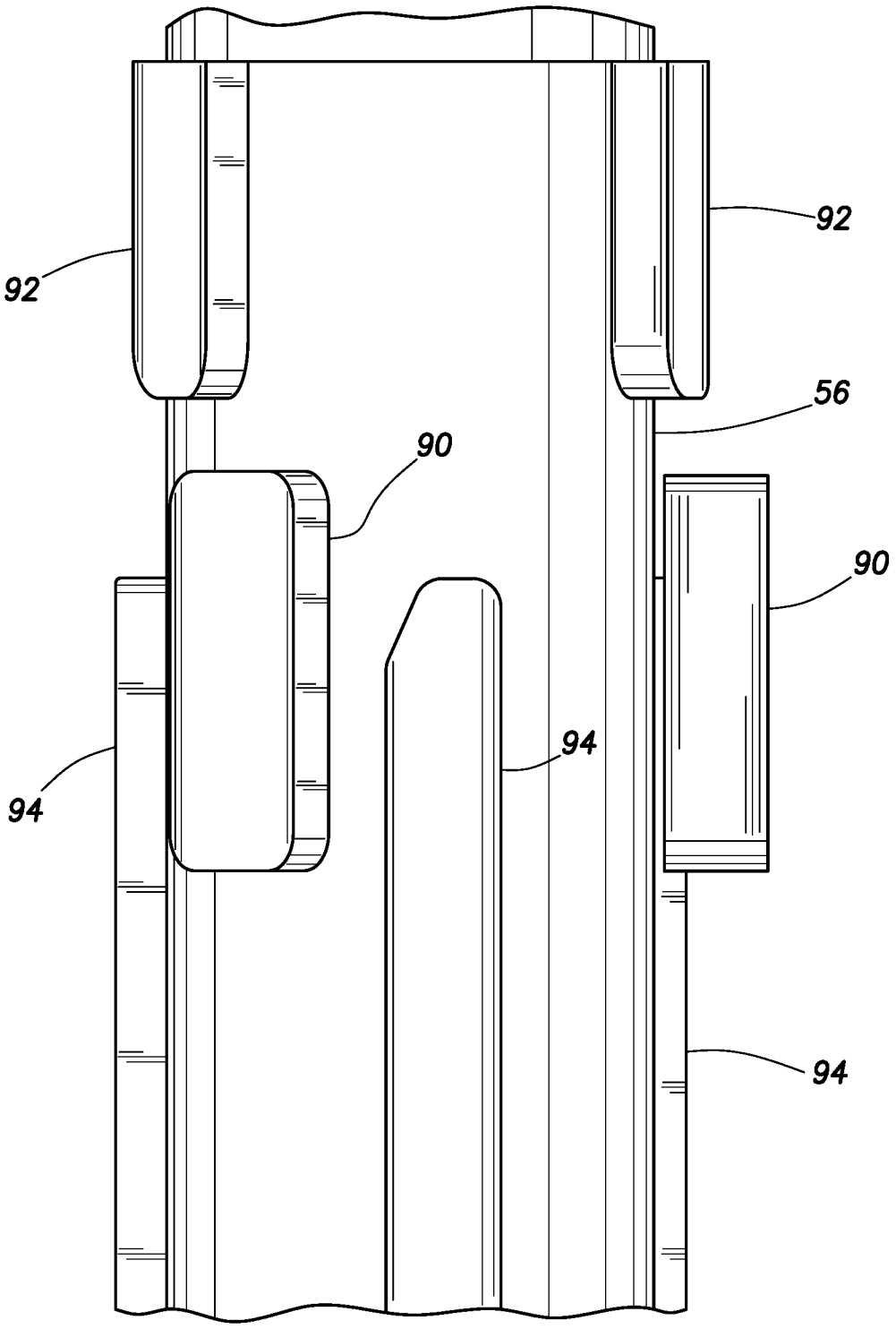
Figure 8C:
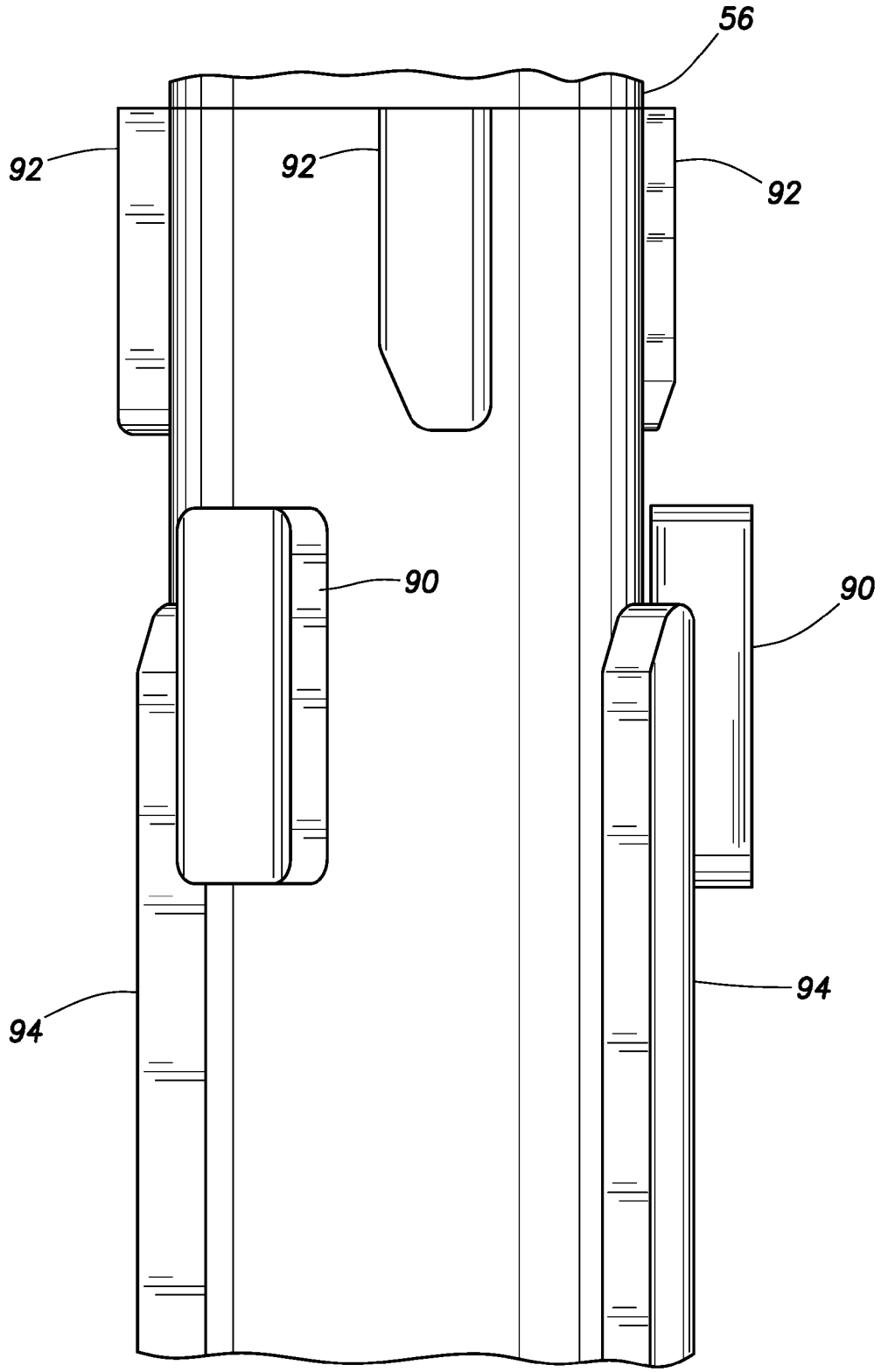

Referring additionally now to FIGS. 8A-C, different operational configurations of the torque transfer arrangement of the packer 40 are representatively illustrated. In FIGS. 8A-C, side views of the keys 90 and inner mandrel 56 are depicted, apart from the remainder of the packer 40.

FIG. 8A depicts the configuration of FIG. 7 described above, in which the keys 90 contact the splines 92. In this configuration, clockwise rotation can be transferred from the upper packer section 40*b* to the lower packer section 40*a*.

FIG. 8B depicts a configuration in which the keys 90 are downwardly displaced relative to the splines 92. This configuration occurs when the packer 40 is set by displacing the upper packer section 40*b* downward relative to the lower packer section 40*a*.

Note that the keys 90 are now positioned between splines 94 formed on the inner mandrel 56. The splines 94 are circumferentially offset relative to the splines 92, so that the keys 90 can now be rotated a predetermined amount relative to the inner mandrel 56.

FIG. 8C depicts a configuration in which the keys 90 have been rotated the predetermined amount relative to the inner mandrel 56. The keys 90 now contact the splines 94. This contact prevents further rotation of the keys 90 (and the remainder of the upper packer section 40*b*) relative to the inner mandrel 56 (and the remainder of the lower packer section 40*a*). After this rotation occurs, the packer 40 is still set. After the rotation, the upper packer section 40*b* is picked up to remove the compressive load used to set the packer 40. For example, picking up on the tubular string 30 at the surface relieves the compressive forces on the annular seal 50 and disengages the slips 52 to release the packer 40 from the casing 16. In this process, the keys 90 are again aligned with the splines 92, to enable torque transmission with the packer 40 unset (for example, for drilling ahead or milling).

Thus, when the packer 40 is in the unset configuration of FIG. 8A, torque can be transferred through the packer 40, and the lower packer section 40*a* rotates with the upper packer section 40*b*, with the keys 90 engaged with the splines 92. When the packer 40 is set, as in the FIG. 8B configuration, the keys 90 no longer engage the splines 92. And, when the upper packer section 40*b* is rotated clockwise relative to the lower packer section 40*a* after the packer 40 is set (as in the FIG. 8C configuration), the amount of rotation is limited by engagement of the keys 90 with the splines 94 (as described above, after the rotation, the upper packer section 40*b* is picked up to completely release the packer 40 from the casing 16).

Referring additionally now to FIGS. 9A-D, the packer 40 is representatively illustrated in successive longitudinal cross-sectional views. The packer 40 is in its set configuration as depicted in FIGS. 9A-D.

Figure 9A:
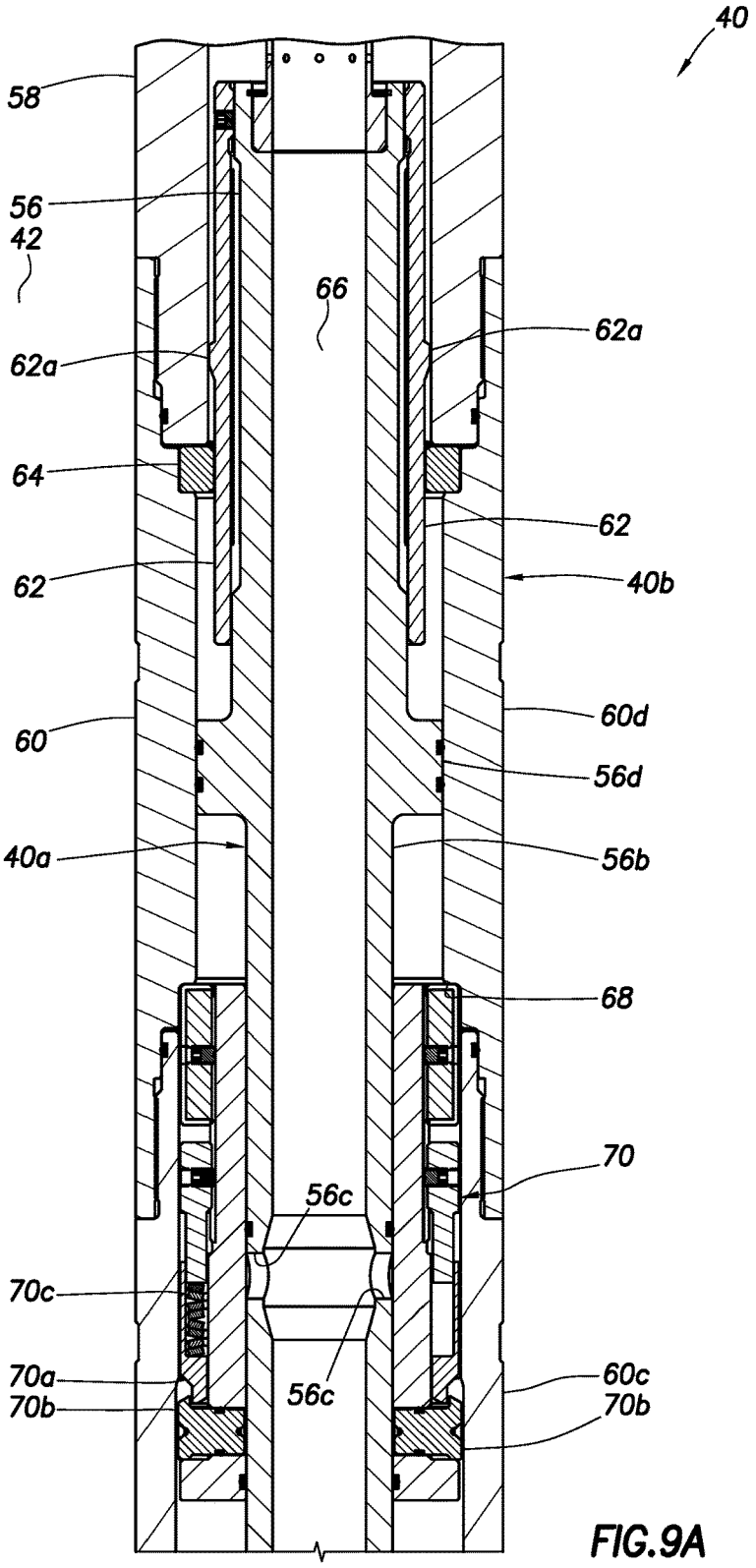
FIGS. 9A-D are representative cross-sectional views of successive longitudinal portions of the packer in a set configuration.

In FIG. 9A, it may be seen that the release ring 64 is now below the projections 62*a* on the collets 62. The lock 70 has been displaced downwardly with the upper packer section 40*b*, so that the pistons 70*b* are no longer aligned with the openings 56*c* in the inner mandrel 56 (as in the configuration of FIG. 6).

Figure 9B:
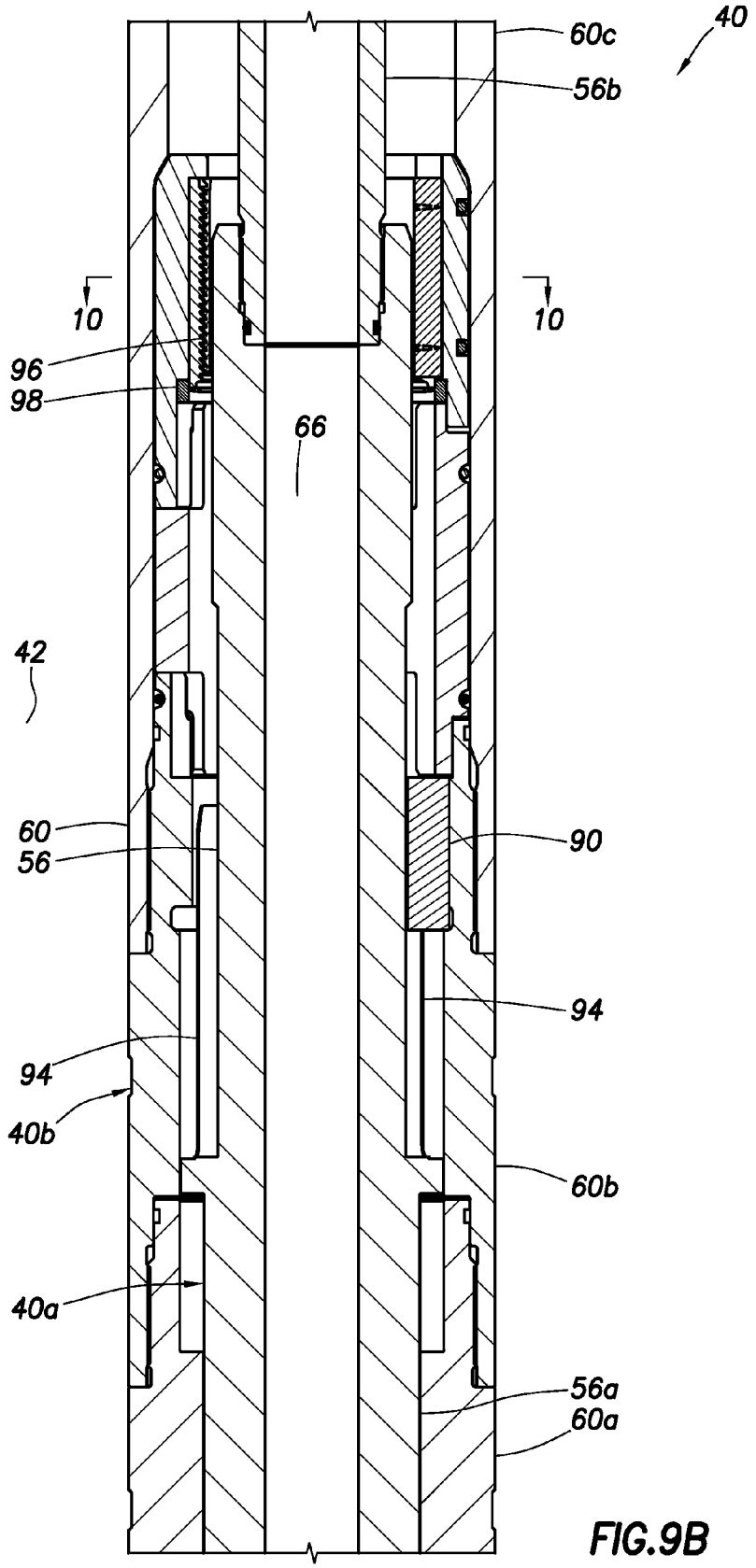

In FIG. 9B, it may be seen that the keys 90 are now positioned between the splines 94 on the mandrel 56 (as in the configuration depicted in FIG. 8B). In addition, an upper end of the lower mandrel section 56*a* is now received in a lock ring or grip device 96 retained in the housing section 60*c*. A shearable member 98 (a ring in this example) retains the grip device 96 in the housing section 60*c*.

Gripping engagement between the grip device 96 and an outer surface of the inner mandrel section 56*a* prevents upward displacement of the upper packer section 40*b* relative to the lower packer section 40*a*, thereby preventing unsetting of the packer 40. The grip device 96 does, however, permit downward displacement of the upper packer section 40*b* relative to the lower packer section 40*a*.

Figure 9C:
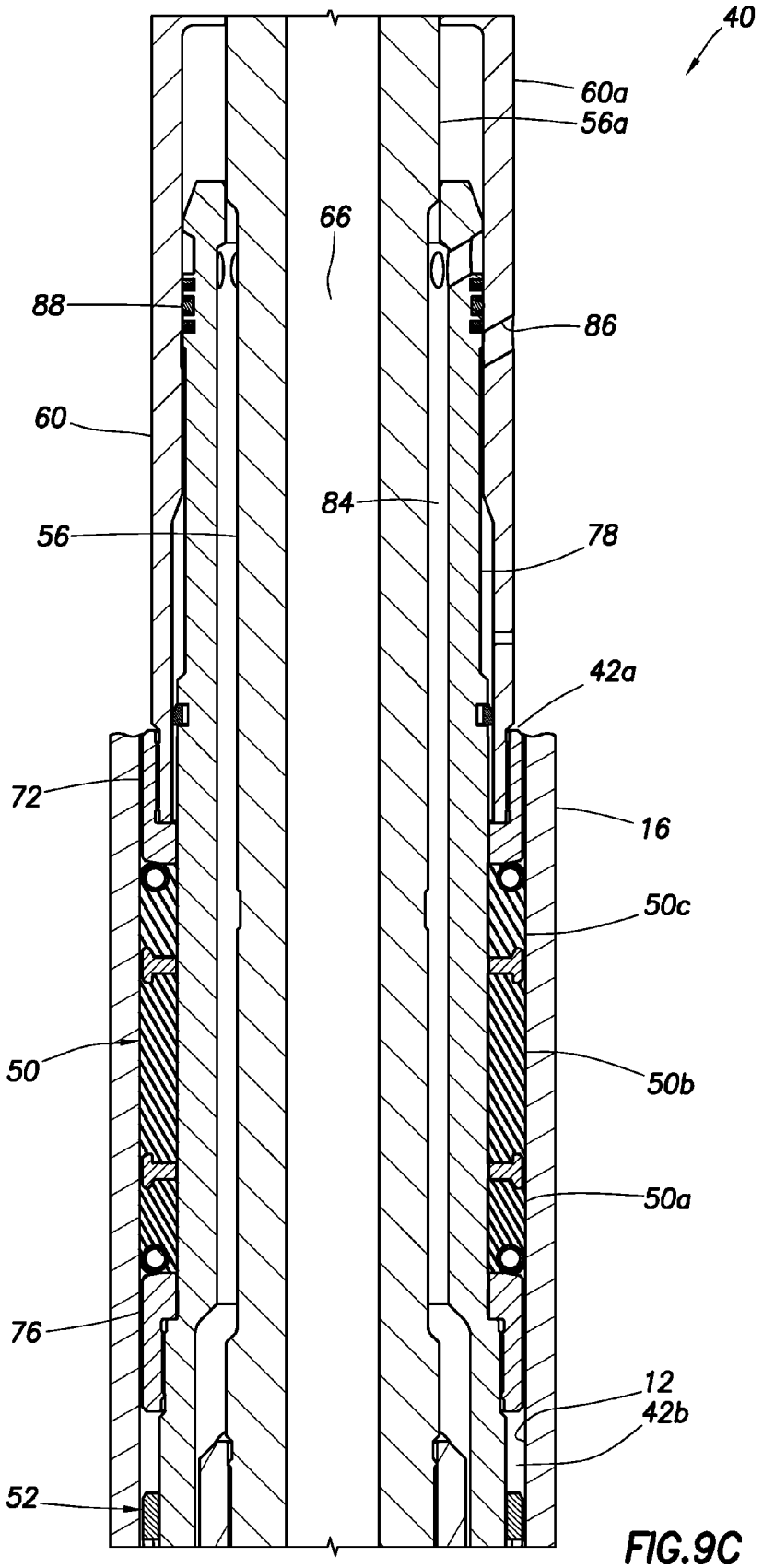

In FIG. 9C, it may be seen that the seal 50 is longitudinally compressed and radially outwardly extended into sealing engagement with a portion of the casing 16. Flow through the bypass passage 84 is prevented, because the seal 88 has been displaced to a position above the ports 86. Thus, the annulus sections 42*a,b* are isolated from each other in the examples of FIGS. 2 & 3.

Figure 9D:
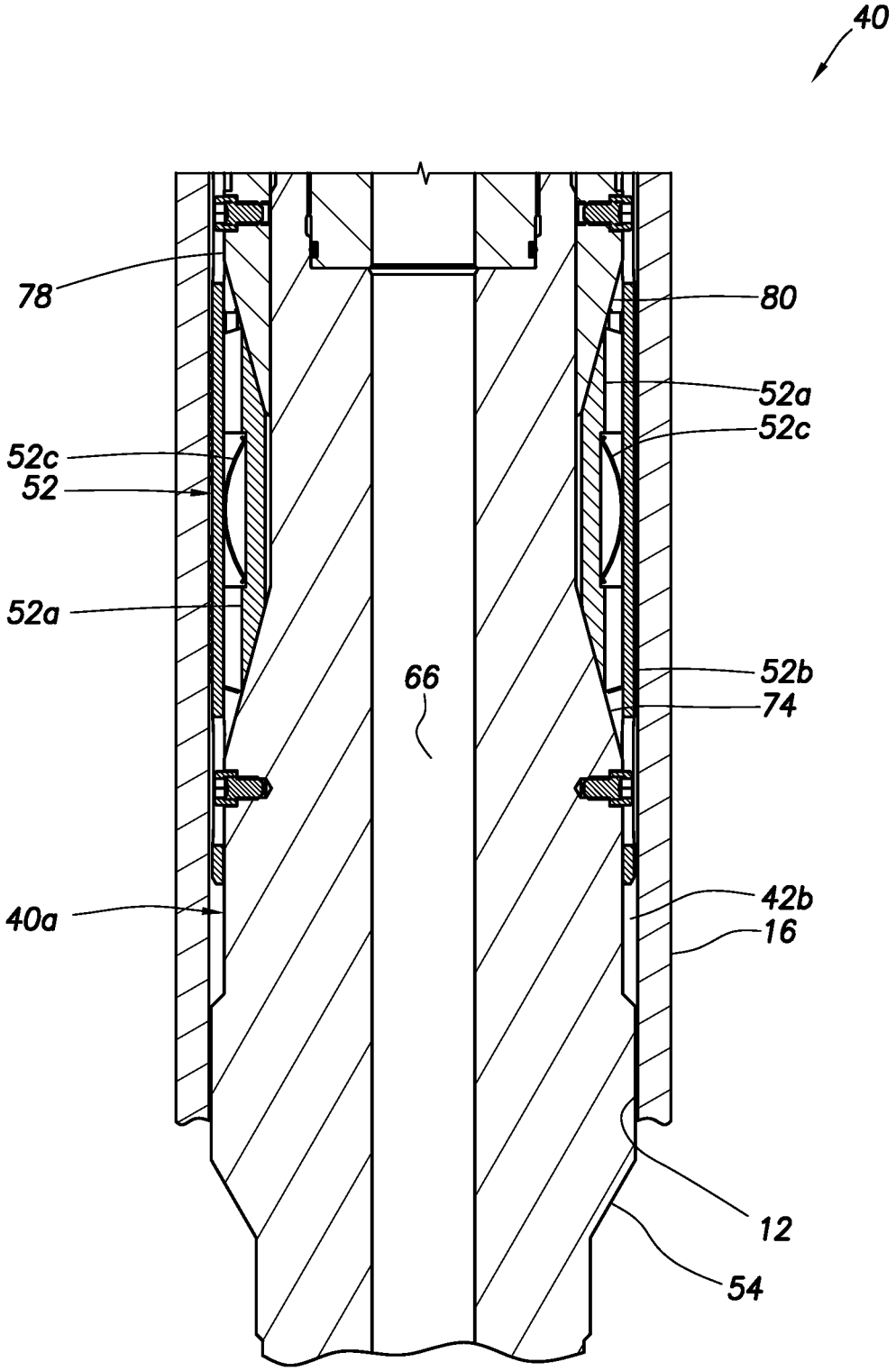

In FIG. 9D, it may be seen that the slips 52 are radially outwardly extended into gripping engagement with the casing 16. Thus, the lower packer section 40*a* is secured against displacement relative to the casing 16.

Figure 10A:
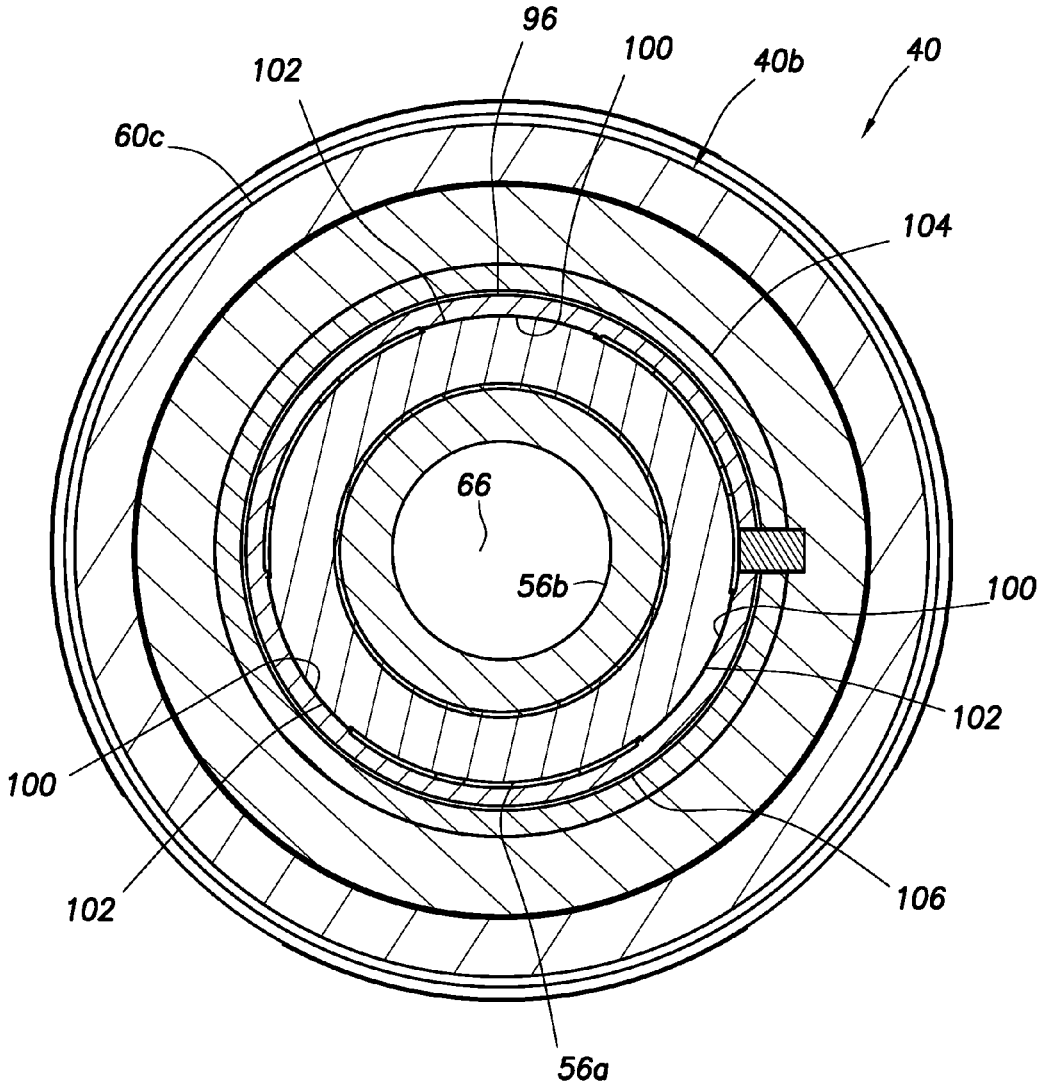
FIGS. 10A & B are representative lateral cross-sectional views of a release mechanism of the packer, in respective engaged and disengaged configurations of the release mechanism, taken along line 10-10 of FIG. 9B.
Figure 10B:
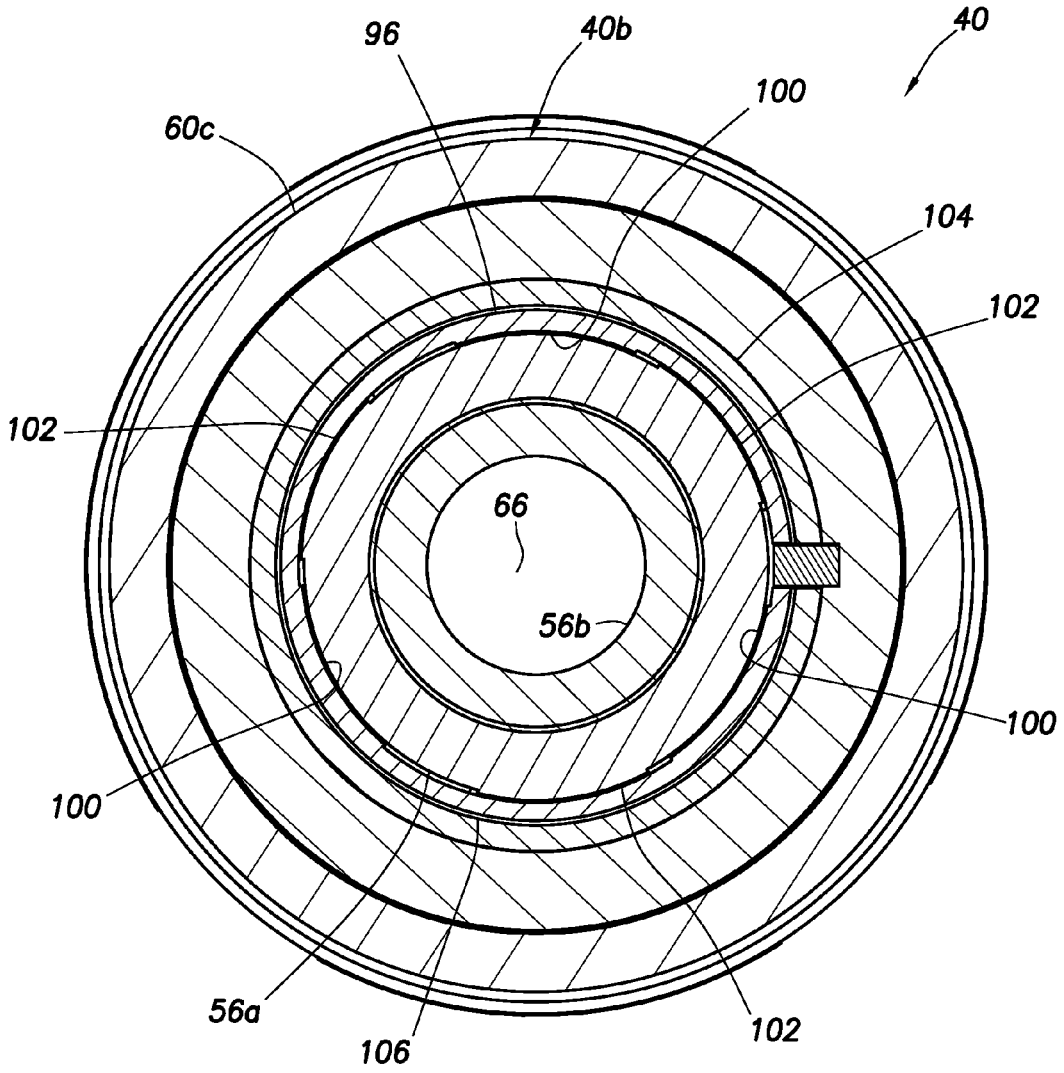

Referring additionally now to FIGS. 10A & B, lateral cross-sectional views of the packer 40 are representatively illustrated, taken along lines 10-10 of FIG. 9B. In FIG. 10A, the packer 40 is in its set configuration (as in FIGS. 9A-D). In FIG. 10B, the packer 40 is in a configuration in which the packer 40 may be unset.

When the packer 40 is set, as depicted in FIG. 10A, threads or other engagement structures 100 formed in the grip device 96 engage complementarily shaped threads or other engagement structures 102 formed on an outer surface of the inner mandrel section 56*a*. This engagement between the engagement structures 100, 102 prevents the housing section 60*c* and the remainder of the upper packer section 40*b* from subsequently displacing upward relative to the inner mandrel section 56*a* and the remainder of the lower packer section 40*a*. Thus, once the packer 40 is set, the engagement between the grip device 96 and the inner mandrel section 56*a* prevents the packer 40 from being unset.

The grip device 96 is positioned in a sleeve 104 having an inner ramped configuration that is complementarily shaped relative to an outer surface of the grip device 96 (the ramped configuration is visible in FIG. 9B). For example, the ramped configuration could comprise buttress-type threads 106 that are inclined in a direction that causes the grip device 96 to be biased radially inward into gripping engagement with the inner mandrel section 56*a* if an attempt is made to displace the upper packer section 40*b* upward relative to the lower packer section 40*a*, but which allows the grip device 96 to deflect radially outward to receive the inner mandrel section 56*a* therein as the packer 40 is set by displacing the upper packer section 40*b* downward relative to the lower packer section 40*a*.

Note that, in the FIG. 10A example, there are three circumferentially spaced apart sets of the engagement structures 100, and there are three circumferentially spaced apart sets of the engagement structures 102. The engagement structures 100 are circumferentially aligned with respective ones of the engagement structures 102, so that the engagement structures 100, 102 engage each other as the inner mandrel section 56*a* is received in the grip device 96. However, since each set of the engagement structures 100, 102 is circumferentially spaced apart from the others, the engagement structures 100 will not engage the engagement structures 102 if they are sufficiently misaligned.

Referring now to FIG. 10B, the packer 40 is depicted after a compressive load has been applied to the packer 40, and the upper packer section 40*b* has been rotated clockwise relative to the lower packer section 40*a*. The compressive load applied may be equal to or greater than the compressive load previously applied to set the packer 40.

Note that the engagement structures 100 in the grip device 96 are no longer aligned with the engagement structures 102 on the inner mandrel section 56*a*. Thus, the engagement structures 100, 102 are disengaged and no longer prevent upward displacement of the upper packer section 40*b* relative to the lower packer section 40*a*.

Appropriate misalignment of the engagement structures 100, 102 when the upper packer section 40*b* is rotated clockwise relative to the lower packer section 40*a* is achieved due to the limited rotational displacement permitted by the keys 90 and the splines 94, as described above in relation to the configuration of FIG. 8C. When the keys 90 contact the splines 94 as depicted in FIG. 8C, the engagement structures 100 are appropriately misaligned with the engagement structures 102, as depicted in FIG. 10B.

The upper packer section 40*b* can now be displaced upward relative to the lower packer section 40*a* to thereby unset the packer 40. When the upper packer section 40*b* is displaced upward to unset the packer 40, the longitudinal compression of the seal 50 is relieved so that it can retract radially inward out of sealing engagement with the wellbore 12, and the slips 52 can retract radially inward out of gripping engagement with the wellbore 12 (the support sleeve 78 and wedge 80 displace upward with the upper packer section 40*b*, allowing the biasing devices 52*c* to inwardly displace the slip members 52*a*). In addition, the bypass passage 84 is again opened to flow, since the ports 86 will again be positioned above the seal 88.

Thus, to unset the packer 40 from its FIGS. 9A-D set configuration, a compressive load is applied to the packer 40 (for example, by slacking off on the tubular string 30 at the surface), the upper packer section 40*b* is rotated to the right (clockwise as viewed from above) relative to the lower packer section 40*a* (for example, by rotating the tubular string 30 to the right at the surface), and then the upper packer section 40*b* is displaced upward relative to the lower packer section 40*a* (for example, by picking up on the tubular string 30 at the surface). When the packer 40 is unset in this manner, it will resume its FIGS. 4A-E configuration, except that the lock 70 will remain deactivated (as depicted in FIG. 6) and the engagement structures 100, 102 will be misaligned (as depicted in FIG. 10B).

The packer 40 can be set again by rotating the upper packer section 40*b* to the right relative to the lower packer section 40*a* (for example, by rotating the tubular string 30 to the right at the surface), thereby again aligning the engagement structures 100, 102, and then applying a sufficient compressive load to the packer 40 (for example, by slacking off on the tubular string 30 at the surface) to cause the slips 52 to extend radially outward into gripping engagement with the wellbore 12, and to cause the seal 50 to extend radially outward into sealing engagement with the wellbore 12. The packer 40 can be set, unset and re-set as many times as desired.

Note that, in the re-setting operation, when the upper packer section 40*b* is rotated to the right relative to the lower packer section 40*a* to thereby align the engagement structures 100, 102, appropriate alignment is achieved due to the limited rotational displacement permitted by the keys 90 and the splines 92 (as depicted in FIGS. 7 & 8A). When the keys 90 contact the splines 92, due to the rotation of the upper packer section 40*b* relative to the lower packer section 40*a*, the engagement structures 100 are appropriately aligned with the engagement structures 102 (as depicted in FIG. 10A).

The packer 40 includes a contingency unsetting capability, in the event that the unsetting operation described above cannot be performed or is unsuccessful. The contingency unsetting operation is performed by applying a sufficient tensile load to the packer 40 (for example, by picking up on the tubular string 30 at the surface) to thereby shear the member 98 that retains the grip device 96 in the housing section 60*c* (see FIG. 9B). This will allow the upper packer section 40*b* to displace upward relative to the lower packer section 40*b* and thereby unset the packer 40 (e.g., by permitting the seal 50 and slips 52 to inwardly retract out of engagement with the wellbore 12).

Figure 11A:
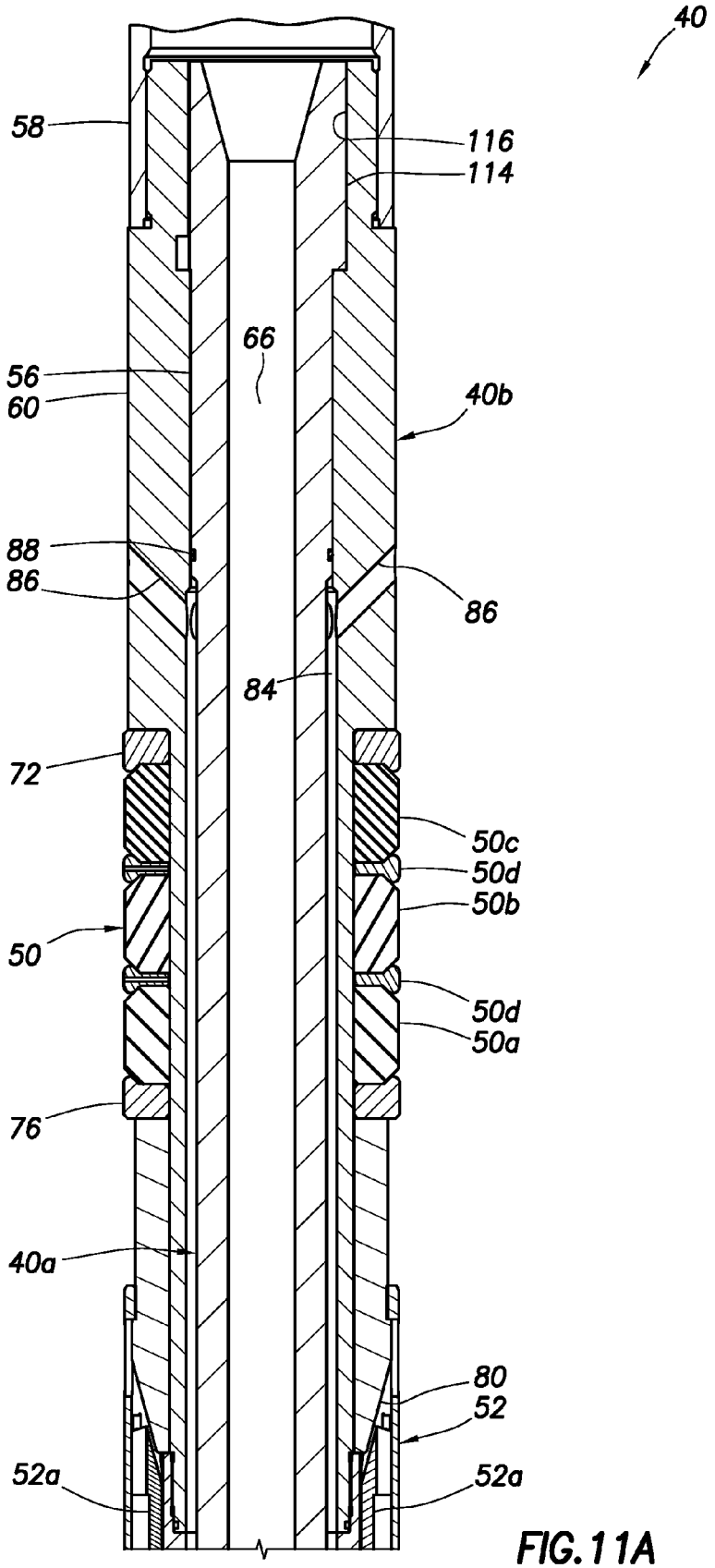
FIGS. 11A & B are representative cross-sectional views of successive longitudinal portions of another example of the packer.

Referring additionally now to FIGS. 11A & B, cross-sectional views of successive longitudinal sections of another example of the packer 40 are representatively illustrated. The packer 40 example of FIGS. 11A & B is similar in many respects to the packer 40 example of FIGS. 4A-10B, and so components of the FIGS. 11A & B example that perform the same or similar functions to those of the FIGS. 4A-10B example are indicated in FIGS. 11A & B with the same reference numbers.

Figure 11B:
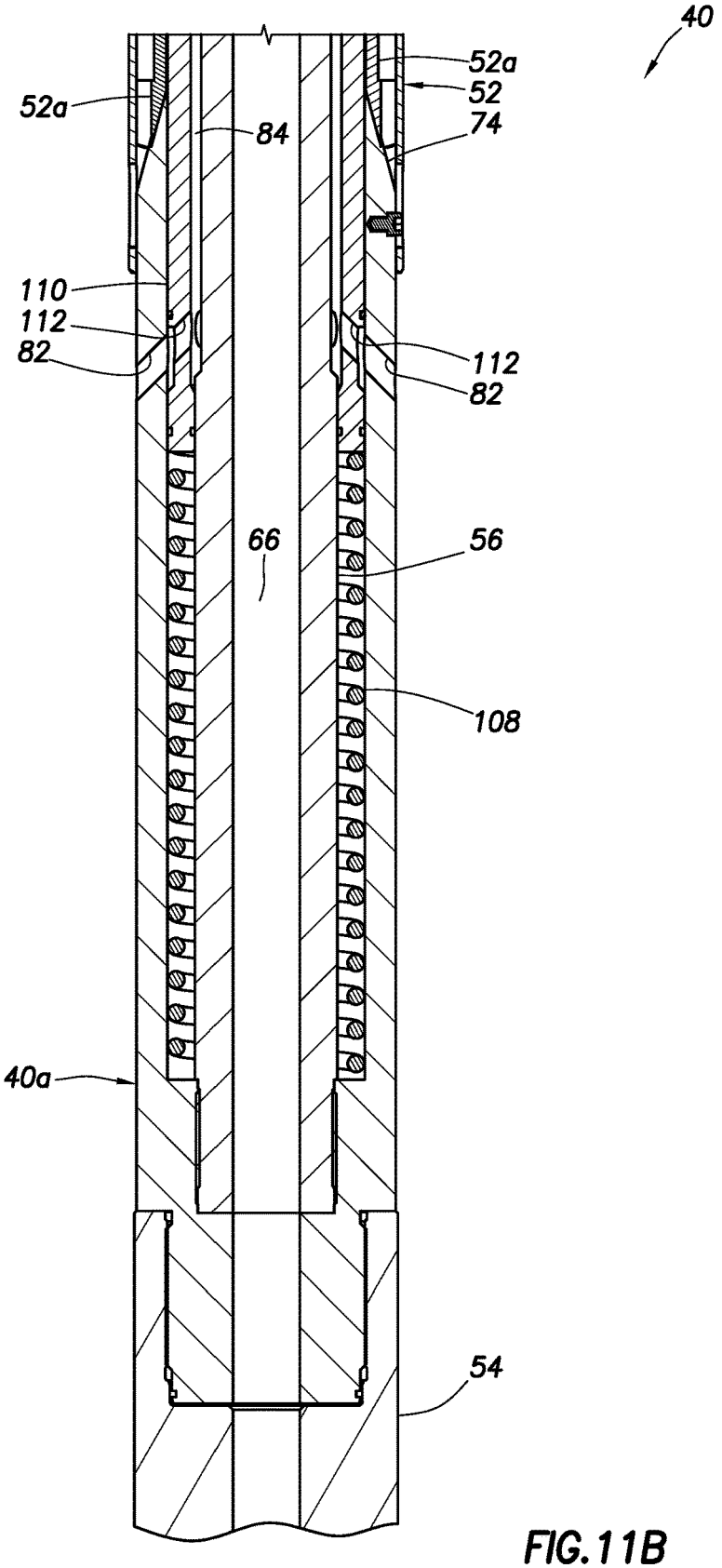

One significant difference in the FIGS. 11A & B example is that the lock 70 is not included. Instead, a biasing device 108 is used in the FIGS. 11A & B example to bias the upper packer section 40*b* upward relative to the lower packer section 40*a*. The biasing device 108 is depicted in FIG. 11B as a compression spring, but other types of biasing devices (such as, a compressed gas chamber, an elastomeric material, a compressible fluid, etc.) may be used in other examples.

The biasing device 108 exerts an upward biasing force against a sleeve 110 reciprocably disposed radially between the inner mandrel 56 and the slips 52. Near a lower end thereof, the sleeve 110 has ports 112 formed therein to provide for fluid communication between the ports 82 and the bypass passage 84.

The sleeve 110 is connected at an upper end thereof to the housing 60 of the upper packer section 40*b*. Thus, in order to displace the upper packer section 40*b* downward relative to the lower packer section 40*a* (in order to set the packer 40), a sufficient compressive load must be applied to the packer 40 to overcome the biasing force exerted by the biasing device 108. When the biasing force is overcome, the upper packer section 40*b* displaces downward relative to the lower packer section 40*a*, and thereby causes the slips 52 to extend radially outward, and causes the seal 50 to extend radially outward, as described above for the example of FIGS. 4A-10B.

The packer 40 example of FIGS. 11A & B also does not include the grip device 96 of the FIGS. 4A-10B example. Thus, the upper packer section 40*b* of the FIGS. 11A & B example can be displaced upward relative to the lower packer section 40*a* (in order to unset the packer 40) by reducing the compressive load.

When the compressive load is sufficiently reduced, the biasing device 108 will displace the upper packer section 40*b* upward relative to the lower packer section 40*a*, and thereby allow the seal 50 and slips 52 to radially inwardly retract. The packer 40 example of FIGS. 11A & B can be set, unset and re-set any desired number of times.

Note that torque can be transmitted through the packer 40 example of FIGS. 11A & B. Transmission of torque and rotation through the packer 40 can be useful, for example, if the packer 40 is to be utilized in cutting operations, such as drilling or milling operations, or if it is otherwise desired to rotate a tubular string connected below the packer 40.

For this purpose, a radially outwardly extending lug or key 114 is formed at an upper end of the inner mandrel 56. The key 114 engages a groove or slot 116 formed in the housing 60. This engagement permits relative longitudinal displacement between the mandrel 56 and the housing 60 (for example, during setting and unsetting of the packer 40), while also transmitting torque from the upper packer section 40*b* to the lower packer section 40*a*.

It may now be fully appreciated that the above disclosure provides significant advancements to the arts of designing, constructing and utilizing annular isolators. In examples described above, the packer 40 can be conveniently and reliably set and unset in the wellbore 12. In the example of FIGS. 4A-10B, the lock 70 can prevent inadvertent setting of the packer 40, until a predetermined pressure differential is applied from the interior to the exterior of the packer 40, and without use of any shearable members exposed to forces due to friction drag or obstructions encountered while running in.

A method for use with a subterranean well is provided to the art by the above disclosure. In one example, the method can comprise increasing a pressure differential from an interior to an exterior of a packer 40, thereby deactivating a lock 70 that prevents setting of the packer 40; and applying a first compressive load to a tubular string 30, thereby setting the packer 40.

The setting step may be performed without shearing any structure of the packer 40.

The method may include transmitting torque through the packer 40 to a cutting tool 32 connected at a distal end of the tubular string 30.

The method may include unsetting the packer 40, the unsetting step comprising: applying a second compressive load to the tubular string 30, rotating a section 40*b* of the packer 40, and applying a tensile load to the tubular string 30 at the packer 40.

The packer 40 may include an inner mandrel 56, and the rotating step may comprise misaligning one or more first engagement structures 102 on the inner mandrel 56 relative to one or more second engagement structures 100 in the packer section 40*b*. The first engagement structures 102 may be circumferentially spaced apart on the inner mandrel 56, and the second engagement structures 100 may be circumferentially spaced apart in the packer section 40*b*.

The method may include resetting the packer 40, the resetting step including applying a third compressive load to the tubular string 30. The resetting step may further include, prior to the third compressive load applying step, circumferentially aligning one or more first engagement structures 102 on an inner mandrel 56 with one or more second engagement structures 100 of the packer section 40*b*.

The method may include unsetting the packer 40, with the unsetting step comprising: applying a tensile load to the tubular string 30 at the packer 40, and in response to the tensile load applying step, shearing a member 98 that prevents displacement of a grip device 96 with an inner mandrel 56 of the packer 40.

The packer 40 setting step may comprise engaging one or more first engagement structures 102 circumferentially spaced apart on the inner mandrel 56 with one or more second engagement structures 100 circumferentially spaced apart in the grip device 96, thereby permitting displacement of the grip device 96 relative to the inner mandrel 56 in only one longitudinal direction.

The method may include permitting flow through a bypass passage 84 in the packer 40 while the bypass passage 84 is in communication with opposite sides of an outer annular seal 50 of the packer 40. The setting step may comprise preventing flow through the bypass passage 84.

The packer 40 is prevented from setting if a pressure differential across a piston 56*d* formed on the inner mandrel 56 is greater than a predetermined level. The pressure differential is from the interior to the exterior of the packer 40 (an upper side of the piston 56*d* is exposed to pressure in the passage 66 and a lower side of the piston 56*d* is exposed to pressure in the annulus 42 in the system 10 example of FIG. 1).

Also provided to the art by the above disclosure is a packer 40 for use with a subterranean well. In one example, the packer 40 can comprise an annular seal 50 that extends radially outward in response to a compressive load applied to opposite ends of the packer 40; and a lock 70 that prevents relative longitudinal displacement between first and second sections 40*a,b* of the packer 40, the lock 70 including a radially displaceable piston 70*b*.

The piston 70*b* may displace in response to an increase in a pressure differential from an interior to an exterior of the packer 40.

The lock 70 may further include a latch 70*a* that permits displacement of the piston 70*b* in a first radial direction, but prevents displacement of the piston 70*b* in a second radial direction opposite to the first radial direction.

The first packer section 40*a* may include an inner mandrel 56 with circumferentially spaced apart first engagement structures 102, and the second packer section 40*b* may include a grip device 96 with circumferentially spaced apart second engagement structures 100. Displacement of the second packer section 40*b* relative to the first packer section 40*a* in a first longitudinal direction is prevented in response to engagement between the first and second engagement structures 102, 100. Displacement of the second packer section 40*b* relative to the first packer section 40*a* in the first longitudinal direction is permitted in response to rotational misalignment between the first and second engagement structures 102, 100.

The grip device 96 may be retained with the second packer section 40*b* by a shearable member 98. Displacement of the second packer section 40*b* relative to the first packer section 40*a* in the first longitudinal direction is permitted in response to the member 98 being sheared.

Also described above is a packer 40 for use with a subterranean well which, in one example, includes an annular seal 50 that extends radially outward in response to relative displacement between first and second sections 40*a,b* of the packer 40; the first packer section 40*a* including an inner mandrel 56 with circumferentially spaced apart first engagement structures 102; and the second packer section 40*b* including a grip device 96 with circumferentially spaced apart second engagement structures 100. Displacement of the second packer section 40*b* relative to the first packer section 40*a* in a first longitudinal direction is prevented in response to engagement between the first and second engagement structures 102, 100. Displacement of the second packer section 40*b* relative to the first packer section 40*a* in the first longitudinal direction is permitted in response to rotational misalignment between the first and second engagement structures 102, 100.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A packer for use with a subterranean well, the packer comprising:

an annular seal that extends radially outward in response to relative displacement between first and second sections of the packer;

the first packer section including an inner mandrel with circumferentially spaced apart first engagement structures; and the second packer section including a grip device with circumferentially spaced apart second engagement structures, wherein displacement of the second packer section relative to the first packer section in a first longitudinal direction is prevented in response to engagement between the first and second engagement structures, and wherein displacement of the second packer section relative to the first packer section in the first longitudinal direction is permitted in response to misalignment between the first and second engagement structures resulting from relative rotation between the first and second packer sections.

2. The packer of claim 1, wherein the grip device is retained with the second packer section by a shearable member, and wherein displacement of the second packer section relative to the first packer section in the first longitudinal direction is permitted in response to the member being sheared.

3. The packer of claim 1, further comprising a lock that prevents displacement of the second packer section in a second longitudinal direction relative to the first packer section, the second longitudinal direction being opposite to the first longitudinal direction, and wherein the lock is deactivated in response to an increase in a pressure differential from an interior to an exterior of the packer.

4. The packer of claim 3, wherein the lock includes at least one piston that displaces radially in response to the increase in the pressure differential.

5. The packer of claim 4, wherein the lock further includes a latch that permits displacement of the piston in a first radial direction, but prevents displacement of the piston in a second radial direction opposite to the first radial direction.

6. The packer of claim 1, wherein the rotational misalignment occurs in response to engagement of a key in the second packer section with a first spline on the inner mandrel.

7. The packer of claim 6, wherein the engagement between the first and second engagement structures occurs in response to engagement of the key with a second spline on the inner mandrel.

8. The packer of claim 1, wherein the grip device permits displacement of the second packer section relative to the first packer section in a second longitudinal direction opposite to the first longitudinal direction.

9. The packer of claim 1, wherein the grip device is biased radially inward in response to attempted displacement of the second packer section in the first longitudinal direction relative to the first packer section.

10. The packer of claim 1, wherein the second engagement structures grip the inner mandrel in response to attempted displacement of the second packer section in the first longitudinal direction relative to the first packer section.

11. The packer of claim 1, wherein the second engagement structures deflect radially outward in response to displacement of the second packer section relative to the first packer section in a second longitudinal direction opposite to the first longitudinal direction.

* * * * *